US010139125B2

(12) United States Patent
Azuma et al.

(10) Patent No.: US 10,139,125 B2
(45) Date of Patent: Nov. 27, 2018

(54) AIR-CONDITIONING APPARATUS

(71) Applicant: Mitsubishi Electric Corporation, Tokyo (JP)

(72) Inventors: Koji Azuma, Tokyo (JP); Hirofumi Koge, Tokyo (JP); Osamu Morimoto, Tokyo (JP); Kensaku Hatanaka, Tokyo (JP); Kazuyoshi Shinozaki, Cypress, CA (US)

(73) Assignee: Mitsubishi Electric Corporation, Tokyo (JP)

( * ) Notice: Subject to any disclaimer, the term of this patent is extended or adjusted under 35 U.S.C. 154(b) by 92 days.

(21) Appl. No.: 15/316,860

(22) PCT Filed: Jul. 13, 2015

(86) PCT No.: PCT/JP2015/070081
§ 371 (c)(1),
(2) Date: Dec. 7, 2016

(87) PCT Pub. No.: WO2016/010007
PCT Pub. Date: Jan. 21, 2016

(65) Prior Publication Data

US 2017/0097177 A1 Apr. 6, 2017

(30) Foreign Application Priority Data

Jul. 14, 2014 (WO) ..... PCT/JP2014/068739

(51) Int. Cl.
*F25B 13/00* (2006.01)
*F25B 49/02* (2006.01)
(Continued)

(52) U.S. Cl.
CPC ..... *F24F 11/89* (2018.01); *F25B 13/00* (2013.01); *F25B 47/003* (2013.01);
(Continued)

(58) Field of Classification Search
CPC ..... F25B 13/00; F25B 47/003; F25B 47/006; F25B 49/02; F25B 2313/0231;
(Continued)

(56) References Cited

U.S. PATENT DOCUMENTS

2006/0272342 A1 12/2006 Bash et al.
2011/0197601 A1 8/2011 Booth et al.
(Continued)

FOREIGN PATENT DOCUMENTS

EP 2650621 A1 10/2013
JP 06-255356 A 9/1994
(Continued)

OTHER PUBLICATIONS

International Search Report of the International Searching Authority dated Oct. 6, 2015 for the corresponding international application No. PCT/JP2015/070081 (and English translation).

*Primary Examiner* — Marc Norman
(74) *Attorney, Agent, or Firm* — Posz Law Group, PLC

(57) ABSTRACT

An air-conditioning apparatus includes at least one system including a heat-medium conveying device, a heat-medium flow regulator, and a heat-medium flow control device, as a heat medium system capable of regulating a flow rate of a heat medium supplied to a heat source device-side heat exchanger exchanging heat between refrigerant and the heat medium. The air-conditioning apparatus switches each of a plurality of use-side heat exchangers to a cooling operation or a heating operation in accordance with a control command to perform a cooling and heating simultaneous operation. The refrigerant is caused to flow through the heat source device-side heat exchanger depending on a ratio of a total cooling capacity and a total heating capacity of the plurality of use-side heat exchangers. The heat-medium flow control device controls the flow rate of the heat medium supplied to the heat source device-side heat exchanger based
(Continued)

on a difference between the total cooling capacity and the total heating capacity of the plurality of use-side heat exchangers and a total operation capacity of the heat source device-side heat exchanger.

17 Claims, 10 Drawing Sheets

(51) Int. Cl.
*F24F 11/89* (2018.01)
*F25B 47/00* (2006.01)

(52) U.S. Cl.
CPC ..... *F25B 47/006* (2013.01); *F25B 49/02* (2013.01); *F25B 2313/004* (2013.01); *F25B 2313/006* (2013.01); *F25B 2313/0231* (2013.01); *F25B 2313/0233* (2013.01); *F25B 2313/0253* (2013.01); *F25B 2313/0272* (2013.01); *F25B 2313/0291* (2013.01); *F25B 2313/0294* (2013.01); *F25B 2313/02741* (2013.01); *F25B 2313/0311* (2013.01); *F25B 2313/0314* (2013.01); *F25B 2313/0315* (2013.01); *F25B 2341/0661* (2013.01); *F25B 2400/075* (2013.01); *F25B 2400/23* (2013.01); *F25B 2500/19* (2013.01); *F25B 2500/26* (2013.01); *F25B 2600/01* (2013.01); *F25B 2600/2509* (2013.01); *F25B 2600/2513* (2013.01); *F25B 2700/1931* (2013.01); *F25B 2700/1933* (2013.01)

(58) Field of Classification Search
CPC ..... F25B 2313/0233; F25B 2313/0291; F25B 2313/0311; F25B 2313/0314; F25B 2313/0315; F25B 2341/061; F25B 2500/19; F25B 2500/26; F25B 2600/01; F25B 2600/2513; F25B 2700/1931; F25B 2700/1933; F24F 11/89
See application file for complete search history.

(56) References Cited

U.S. PATENT DOCUMENTS

| | | | | |
|---|---|---|---|---|
| 2012/0078424 | A1 | 3/2012 | Raghavachari | |
| 2013/0091877 | A1 | 4/2013 | Cho et al. | |
| 2013/0098073 | A1 | 4/2013 | Cho et al. | |
| 2013/0312443 | A1 | 11/2013 | Tamaki et al. | |
| 2014/0150483 | A1* | 6/2014 | Takayama | F25B 13/00 62/160 |
| 2014/0318163 | A1* | 10/2014 | Takayama | F25B 49/00 62/196.1 |
| 2015/0034293 | A1* | 2/2015 | Takayama | F25B 13/00 165/207 |
| 2015/0059380 | A1* | 3/2015 | Takayama | F25B 13/00 62/222 |

FOREIGN PATENT DOCUMENTS

| | | | |
|---|---|---|---|
| JP | 2522361 | B | 8/1996 |
| JP | 2006-078026 | A | 3/2006 |
| JP | 2009-198099 | A | 9/2009 |
| JP | 2011-017526 | A | 1/2011 |
| JP | 4832960 | B | 12/2011 |
| JP | 2012-220114 | A | 11/2012 |

* cited by examiner

FIG. 6

| HEAT MEDIUM FLOW REGULATION STATE | PATTERN A | PATTERN B | PATTERN C | PATTERN D |
|---|---|---|---|---|
| CONDITIONS | (a) and (b)<br>(a) COMPRESSOR OF HEAT SOURCE DEVICE IS IN STOPPED STATE<br>(b) COMPRESSORS OF COMBINED HEAT SOURCE DEVICES ARE ALL IN STOPPED STATE | (a) and (b)<br>(a) COMPRESSOR OF HEAT SOURCE DEVICE IS IN STOPPED STATE<br>(b) ONE OR MORE COMPRESSORS OF COMBINED HEAT SOURCE DEVICES ARE OPERATING | (a) and (b)<br>(a) COMPRESSOR OF HEAT SOURCE DEVICE IS OPERATING<br>(b) COMPRESSOR OPERATING TIME PERIOD ≥ PREDETERMINED TIME PERIOD T0: 5 [min] | (a) and (b)<br>(a) COMPRESSOR OF HEAT SOURCE DEVICE IS OPERATING<br>(b) COMPRESSOR OPERATING TIME PERIOD < PREDETERMINED TIME PERIOD T0: 5 [min] |
| NECESSARY FLOW RATE OF HEAT MEDIUM SUPPLIED TO HEAT SOURCE DEVICE | 0 [$m^3/h$] | LOWER LIMIT FLOW RATE [$m^3/h$] | $Gw = (Gwmax - Gwmin) \times [\lvert \Sigma Qjc - \Sigma Qjh \rvert / \Sigma Qjo] + Gwmin$<br>Gw: FLOW RATE OF HEAT MEDIUM<br>Gwmax: HEAT MEDIUM RATED FLOW RATE<br>Gwmin: HEAT MEDIUM LOWER LIMIT FLOW RATE<br>ΣQjc: SUM OF INDOOR UNIT COOLING OPERATION CAPACITIES<br>ΣQjh: SUM OF INDOOR UNIT HEATING OPERATION CAPACITIES<br>ΣQjo: HEAT SOURCE DEVICE OPERATION CAPACITY | RATED FLOW RATE [$m^3/h$] |
| VOLTAGE OUTPUT VALUE TO HEAT-MEDIUM FLOW REGULATOR | 10 [V] | 5 [V] | $V = (Vo - Vmin) \times [\frac{\lvert \Sigma Qjc - \Sigma Qjh \rvert}{\Sigma Qjo}] + Vmin$<br>V: COMMAND VOLTAGE [V] TO HEAT-MEDIUM FLOW REGULATOR<br>Vmin: COMMAND VOLTAGE [V] (5 V) TO HEAT-MEDIUM FLOW REGULATOR DURING HEAT-MEDIUM LOWER LIMIT FLOW RATE<br>dV: AMOUNT OF VOLTAGE CHANGE [V]<br>Vo: COMMAND VOLTAGE [V] AT TIME OF FULL OPENING = 0 V<br>* ABOVE EXPRESSION ASSUMES CASE WHERE COMMAND VOLTAGE TO HEAT-MEDIUM FLOW REGULATOR AND Cv VALUE ARE PROPORTIONAL | 0 [V] |

FIG. 10

| HEAT MEDIUM FLOW REGULATION STATE | PATTERN A | PATTERN B | PATTERN C-1 | PATTERN C-2 |
|---|---|---|---|---|
| CONDITIONS | (a) and (b)<br>(a) COMPRESSOR OF HEAT SOURCE DEVICE IS IN STOPPED STATE<br>(b) COMPRESSORS OF COMBINED HEAT SOURCE DEVICES ARE ALL IN STOPPED STATE | (a) and (b)<br>(a) COMPRESSOR OF HEAT SOURCE DEVICE IS IN STOPPED STATE<br>(b) ONE OR MORE COMPRESSORS OF COMBINED HEAT SOURCE DEVICES ARE OPERATING | (a) and (b)<br>(a) COMPRESSOR OF HEAT SOURCE DEVICE IS OPERATING<br>(b) COMPRESSOR OPERATING TIME PERIOD ≥ PREDETERMINED TIME PERIOD T0: 5 [min] | (a) and (b)<br>(a) COMPRESSOR OF HEAT SOURCE DEVICE IS OPERATING<br>(b) COMPRESSOR OPERATING TIME PERIOD ≥ PREDETERMINED TIME PERIOD T0: 5 [min] |
| NECESSARY FLOW RATE OF HEAT MEDIUM SUPPLIED TO HEAT SOURCE DEVICE | 0 [$m^3/h$] | LOWER LIMIT FLOW RATE [$m^3/h$] | $Gw = (Gwmax - Gwmin) \times \{|\Sigma Qjc - \Sigma Qjh| / \Sigma Qjo\} + Gwmin$<br>Gw: FLOW RATE OF HEAT MEDIUM<br>Gwmax: HEAT MEDIUM RATED FLOW RATE<br>Gwmin: HEAT MEDIUM LOWER LIMIT FLOW RATE<br>ΣQjc: SUM OF INDOOR UNIT COOLING OPERATION CAPACITIES<br>ΣQjh: SUM OF INDOOR UNIT HEATING OPERATION CAPACITIES<br>ΣQjo: HEAT SOURCE DEVICE OPERATION CAPACITY | $Gw = (Gwmax - Gwmin) \times \{(F - Fmin)/(Fmax - Fmin)\} + Gwmin$<br>Gw: FLOW RATE OF HEAT MEDIUM<br>Gwmax: HEAT MEDIUM RATED FLOW RATE<br>Gwmin: HEAT MEDIUM LOWER LIMIT FLOW RATE<br>F: HEAT SOURCE DEVICE FREQUENCY<br>Fmax: HEAT SOURCE DEVICE MAXIMUM FREQUENCY (DETERMINED DEPENDING ON SIZE OF HEAT SOURCE DEVICE UNIT)<br>Fmin: HEAT SOURCE DEVICE MINIMUM FREQUENCY (DETERMINED DEPENDING ON SIZE OF HEAT SOURCE DEVICE UNIT) |
| VOLTAGE OUTPUT VALUE TO HEAT-MEDIUM FLOW REGULATOR | 10 [V] | 5 [V] | $V = (Vo - Vmin) \times \{\frac{|\Sigma Qjc - \Sigma Qjh|}{\Sigma Qjo}\} + Vmin$<br>V: COMMAND VOLTAGE [V] TO HEAT-MEDIUM FLOW REGULATOR<br>Vmin: COMMAND VOLTAGE [V] (5 V) TO HEAT-MEDIUM FLOW REGULATOR DURING HEAT-MEDIUM LOWER LIMIT FLOW RATE<br>dV: AMOUNT OF VOLTAGE CHANGE [V]<br>Vo: COMMAND VOLTAGE [V] AT TIME OF FULL OPENING = 0 V<br>* ABOVE EXPRESSION ASSUMES CASE WHERE COMMAND VOLTAGE TO HEAT-MEDIUM FLOW REGULATOR AND Cv VALUE ARE PROPORTIONAL | $V = (Vo - Vmin) \times (\frac{F - Fmin}{Fmax - Fmin} + Vmin)$<br>V: COMMAND VOLTAGE [V] TO HEAT-MEDIUM FLOW REGULATOR<br>Vmin: COMMAND VOLTAGE [V] (5 V) TO HEAT-MEDIUM FLOW REGULATOR DURING HEAT-MEDIUM LOWER LIMIT FLOW RATE<br>Vo: COMMAND VOLTAGE [V] AT TIME OF FULL OPENING = 0 V<br>* ABOVE EXPRESSION ASSUMES CASE WHERE COMMAND VOLTAGE TO HEAT-MEDIUM FLOW REGULATOR AND Cv VALUE ARE PROPORTIONAL |

AIR-CONDITIONING APPARATUS

CROSS REFERENCE TO RELATED APPLICATIONS

This application is a U.S. national stage application of PCT/JP2015/070081 filed on Jul. 13, 2015, which claims priority to International Patent Application No. PCT/JP2014/068739 filed on Jul. 14, 2014, the contents of which are incorporated herein by reference.

TECHNICAL FIELD

The present invention relates to an air-conditioning apparatus in which a plurality of indoor units are connected to each other so that each of the indoor units can perform cooling and heating selectively or simultaneously.

BACKGROUND ART

In the related-art air conditioning apparatus using a refrigeration cycle (heat pump cycle), a heat source device-side unit (e.g., heat source device or outdoor unit) including a compressor and a heat source device-side heat exchanger and a load-side unit (e.g., indoor unit) including a flow control device (e.g., an expansion valve) and an indoor unit-side heat exchanger are connected to each other by refrigerant pipes to constitute a refrigerant circuit configured to circulate refrigerant. A phenomenon in which the refrigerant is evaporated or condensed in the indoor unit-side heat exchanger by receiving or transferring heat from or to air in an air-conditioned space that is a heat exchange target is used to condition the air by changing a pressure, a temperature, and other related factors of the refrigerant in the refrigerant circuit.

In this case, for example, an existing air conditioning apparatus is capable of performing a simultaneous cooling and heating operation (cooling and heating mixed operation) in which a plurality of indoor units can each automatically determine whether cooling or heating is suitable depending on a temperature set by a remote controller provided to the indoor unit and an air temperature around the indoor unit to perform cooling and heating with each indoor unit (see, for example, Patent Literature 1).

In addition, an existing air-conditioning apparatus is configured to obtain a target value of an outlet temperature of a heat medium to be supplied to the heat source device-side heat exchanger based on a predefined relationship from an inlet temperature of the heat medium and a frequency of the compressor and control a frequency of a heat-medium conveying device (for example, a water pump) to approximate the target value (see, for example, Patent Literature 2).

CITATION LIST

Patent Literature

Patent Literature 1: Japanese Patent No. 2522361
Patent Literature 2: Japanese Patent No. 4832960

SUMMARY OF INVENTION

Technical Problem

As a method of reducing a conductance (AK value=heat transfer area A [$m^2$]×overall heat transfer coefficient K [$W/m^2$]) that is a heat exchange capacity of the heat exchanger in capacity control for the heat exchanger, a conventionally proposed refrigerant circuit in the case of an air heat exchanger is configured to perform capacity control by reducing an amount of fan air, reducing the heat transfer area A through heat exchange division, or bypassing the heat exchanger through which refrigerant flows.

Further, in an air conditioning apparatus capable of performing a cooling and heating mixed operation described in Patent Literature 1, a heat recovery operation is performed between the indoor units. Consequently, an air conditioning load rate is approximately the same for cooling and for heating. Thus, for a complete heat recovery operation, a heat exchange amount in an outdoor heat exchanger is required to be reduced. Specifically, to improve comfort and energy saving performance of the air conditioning apparatus during the heat recovery operation, an amount of transferred heat is required to approximate zero for a cooling main operation, whereas an amount of received heat is required to approximate zero for a heating main operation.

In consideration of device reliability of the compressor, however, a compression ratio of a predetermined value or larger (for example, 2 or larger) is required to be ensured. Thus, during the cooling operation, the AK value is required to be lowered for an operation at a low outdoor air temperature or with a low compressor operation capacity. However, an amount of outdoor fan air is required to be ensured to a constant value or larger to cool an electronic board of an outdoor unit in the case of the air heat exchanger, and a water flow rate is required to be kept to a constant value or larger due to pitting corrosion in the case of a water heat exchanger. Consequently, the AK value cannot be lowered to a desired AK value, resulting in a decreased low pressure of a refrigeration cycle. During cooling, an evaporating temperature is required to be ensured to 0 degree Celsius or higher to prevent freezing of the indoor units. When the low pressure is lowered, however, the device is required to be stopped to prevent the freezing of the indoor units. Consequently, the device is frequently started and stopped, and thus indoor comfort and the energy saving performance are degraded.

Further, in the air-conditioning apparatus disclosed in Patent Literature 2, the frequency of the heat-medium conveying device is controlled depending on the frequency of the compressor. Consequently, the frequency of the heat-medium conveying device varies depending on a transient change in a refrigerant system, e.g., a change in use-side heat exchanger capacity, resulting in a long time period required to stabilize an operation of a heat medium system. Further, when the operation capacity for cooling and the operation capacity for heating are equal to each other although the use-side heat exchanger capacity is large during the cooling and heating mixed operation, a flow rate of the heat medium to be supplied to the heat source device-side heat exchanger can be reduced. However, the frequency of the heat medium conveying device is increased because of a high frequency of the compressor, to thereby degrade the energy saving performance.

The present invention has been made to address the problems described above, and has an object to provide a highly-efficient air-conditioning apparatus capable of performing stable control even in a case where each of a plurality of use-side heat exchangers performs a cooling operation or a heating operation during a cooling and heating simultaneous operation for circulating refrigerant between a heat source device-side heat exchanger and the use-side heat exchangers, and configured to control a flow rate of a heat medium to be supplied to the heat source device-side heat exchanger configured to exchange heat with the refrigerant depending on a use-side heat exchanger capacity to reduce power consumed along with supply of the heat medium.

Solution to Problem

An air-conditioning apparatus according to one embodiment of the present invention includes a compressor configured to compress and discharge refrigerant, a heat source device-side heat exchanger configured to exchange heat between the refrigerant and a heat medium different from the refrigerant, a plurality of use-side heat exchangers configured to exchange heat between the refrigerant and a use-side medium around the plurality of use-side heat exchangers, a relay device provided between the heat source device-side heat exchanger and the plurality of use-side heat exchangers and configured to switch at least one of the plurality of use-side heat exchangers to a cooling operation and switch others of the plurality of use-side heat exchangers to a heating operation, and at least one system including a heat-medium conveying device, a heat-medium flow regulator, and a heat-medium flow control device, as a heat medium system capable of regulating a flow rate of the heat medium supplied to the heat source device-side heat exchanger. The compressor and the heat source device-side heat exchanger are arranged in a heat source device and the plurality of use-side heat exchangers are arranged in an indoor unit. The air-conditioning apparatus is configured to switch each of the plurality of use-side heat exchangers to the cooling operation or the heating operation in accordance with a control command to perform a cooling and heating simultaneous operation. The refrigerant is caused to flow through the heat source device-side heat exchanger depending on a ratio of a total cooling capacity and a total heating capacity of the plurality of use-side heat exchangers. The heat-medium flow control device is configured to control the flow rate of the heat medium supplied to the heat source device-side heat exchanger based on the total cooling capacity and the total heating capacity of the plurality of use-side heat exchangers and a total operation capacity of the heat source device-side heat exchanger.

Advantageous Effects of Invention

In the air-conditioning apparatus according to the one embodiment of the present invention, even when each of the plurality of use-side heat exchangers performs the cooling operation or the heating operation during the cooling and heating simultaneous operation, the comfort can be maintained. Further, the heat-medium flow control device is configured to control the flow rate of the heat medium supplied to the heat source device based on the total cooling capacity and the total heating capacity of the plurality of use-side heat exchangers and the total operation capacity of the heat source device-side heat exchanger. As a result, the flow rate of the heat medium can be reduced depending on the use-side heat exchanger capacity, thereby enabling the reduction of power consumption of a heat medium conveying device (for example, a water pump). Consequently, with the above-mentioned configuration, the effect of enabling execution of a highly-efficient cooling and heating simultaneous operation can be provided.

BRIEF DESCRIPTION OF DRAWINGS

FIG. 6 is a table for showing an example of four patterns of a heat medium flow regulation state according to Embodiment 2 of the present invention.

FIG. 10 is a table for showing an example of four patterns of a heat medium flow regulation state according to Embodiment 3 of the present invention.

DESCRIPTION OF EMBODIMENTS

Embodiments of the present invention are described below in detail with reference to the drawings.

Embodiment 1

Figure 1:
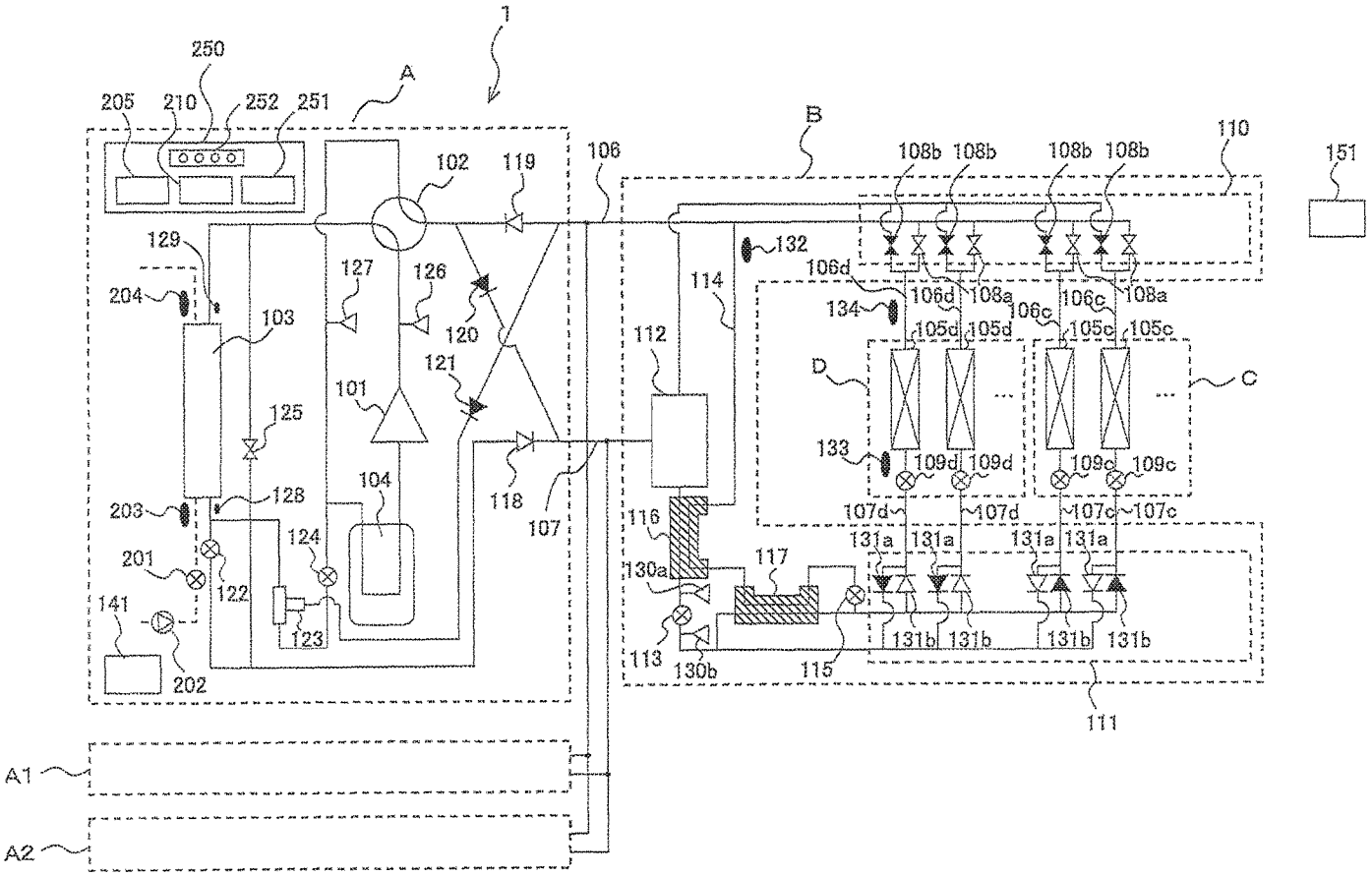
FIG. 1 is a diagram for illustrating a configuration example of an air-conditioning apparatus according to Embodiment 1 of the present invention.

FIG. 1 is a diagram for illustrating a configuration example of an air-conditioning apparatus 1 according to Embodiment 1 of the present invention. As illustrated in FIG. 1, the air-conditioning apparatus 1 includes a heat source device A, a relay device B, an indoor unit C, and an indoor unit D, and uses a four-way valve 102, check valves 118 to 121, and other components to form a cooling refrigeration cycle and a heating refrigeration cycle inside the air-conditioning apparatus 1, thereby circulating refrigerant to perform a cooling and heating simultaneous operation.

When a cooling operation capacity and a heating operation capacity change during the cooling and heating simultaneous operation, pressures detected by pressure detecting units 126 and 127 and temperatures of the heat source device detected by temperature detecting units 128 and 129 are controlled on the heat source device A side, thereby keeping a temperature of the refrigerant flowing into use-side heat exchangers 105*c* and 105*d* (also referred to collectively as "use-side heat exchangers 105") respectively provided to the indoor units C and D within a given range.

As a result, even when the cooling operation capacity and the heating operation capacity change during the cooling and heating simultaneous operation, a stable cooling and heating operation is continued at low cost.

Combined heat source devices A1 and A2 may be provided as the heat source device. A configuration of each of the heat source devices A1 and A2 may be, for example, the same as that of the heat source device A.

Details of the above-mentioned contents are described below sequentially.

In the air-conditioning apparatus 1, the relay device B is provided between the heat source device A and the indoor unit C, and between the heat source device A and the indoor unit D. The heat source device A and the relay device B are connected to each other by a first connecting pipe 106 and a second connecting pipe 107 having a smaller pipe diameter than that of the first connecting pipe 106. Further, the relay device B and the indoor unit C are connected to each other by third connecting pipes 106*c* and fourth connecting pipes 107*c*. Then, the relay device B and the indoor unit D are connected to each other by fifth connecting pipes 106*d* and sixth connecting pipes 107*d*. With this connection configuration, the relay device B relays the refrigerant flowing between the heat source device A and the indoor unit C, and between the heat source device A and the indoor unit D.

Although an example of a case where one heat source device A, one relay device B, and two indoor units C and D are provided is described below, the numbers of these components are not limited to those of the example. For example, a plurality of indoor units, that is, two or more indoor units may be provided. Further, for example, a plurality of heat source devices and a plurality of relay devices may be provided.

The heat source device A includes a compressor 101, the four-way valve 102, a heat source device-side heat exchanger 103, and an accumulator 104. The heat source device A also includes the check valve 118, the check valve 119, the check valve 120, and the check valve 121. Further, the heat source device A includes a fourth flow regulator 122, a gas-liquid separator 123, a fifth flow regulator 124, a switching valve 125, and a control unit 141. Further, the heat source device A includes the first pressure detecting unit 126, the second pressure detecting unit 127, and the temperature detecting units 128 and 129 each provided on a corresponding one of a refrigerant inlet side and a refrigerant outlet side of the heat source device-side heat exchanger 103 to supply pressures and temperatures detected by these detecting units to the control unit 141.

The compressor 101 is provided between the four-way valve 102 and the accumulator 104. The compressor 101 is configured to compress and discharge refrigerant, and has a discharge side connected to the four-way valve 102 and a suction side connected to the accumulator 104.

The four-way valve 102 has four ports. The ports are connected to the discharge side of the compressor 101, the heat source device-side heat exchanger 103, the accumulator 104, and an outlet side of the check valve 119 and an inlet side of the check valve 120 to switch a passage of the refrigerant.

The heat source device-side heat exchanger 103 has one side connected to the four-way valve 102 and an other side connected to a pipe connected to the fourth flow regulator 122 and the gas-liquid separator 123. The switching valve 125 is an openable and closable valve, and is provided in a circuit that bypasses the heat source device-side heat exchanger 103 and the fourth flow regulator 122.

A heat medium exchanges heat with the refrigerant flowing through a refrigerant circuit formed in the heat source device-side heat exchanger 103. This heat medium is different from the refrigerant, and may be, e.g., water or brine.

The accumulator 104 is connected between the four-way valve 102 and the suction side of the compressor 101, and is configured to separate liquid refrigerant and supply gas refrigerant to the compressor 101.

Further, the fifth flow regulator 124 is connected between the accumulator 104 and the gas-liquid separator 123, and is configured to regulate the refrigerant flowing into the heat source device-side heat exchanger 103.

The above-mentioned compressor 101, four-way valve 102, and heat source device-side heat exchanger 103 constitute a part of the refrigerant circuit.

The check valve 118 is provided between the fourth flow regulator 122 connected to the heat source device-side heat exchanger 103, and the second connecting pipe 107 and an outlet side of the check valve 120. An inlet side of the check valve 118 is connected to a pipe connected to the fourth flow regulator 122. The outlet side of the check valve 118 is connected to a pipe connected to the second connecting pipe 107 and the outlet side of the check valve 120. The check valve 118 allows flow of the refrigerant in only one direction from the heat source device-side heat exchanger 103 via the fourth flow regulator 122 to the second connecting pipe 107.

The check valve 119 is provided between the four-way valve 102 and the inlet side of the check valve 120, and the first connecting pipe 106 and an inlet side of the check valve 121. An inlet side of the check valve 119 is connected to a pipe connected to the first connecting pipe 106 and the inlet side of the check valve 121. An outlet side of the check valve 119 is connected to a pipe connected to the four-way valve 102 and the inlet side of the check valve 120. The check valve 119 allows the flow of the refrigerant in only one direction from the first connecting pipe 106 to the four-way valve 102.

The check valve 120 is provided between the four-way valve 102 and the outlet side of the check valve 119, and the outlet side of the check valve 118 and the second connecting pipe 107. The inlet side of the check valve 120 is connected to a pipe connected to the four-way valve 102 and the outlet side of the check valve 119. The outlet side of the check valve 120 is connected to a pipe connected to the outlet side of the check valve 118 and the second connecting pipe 107. The check valve 120 allows the flow of the refrigerant in only one direction from the four-way valve 102 to the second connecting pipe 107.

The check valve 121 is provided between the inlet side of the check valve 119 and the first connecting pipe 106, and the gas-liquid separator 123 connected to the heat source device-side heat exchanger 103. The inlet side of the check valve 121 is connected to a pipe connected to the inlet side of the check valve 119 and the first connecting pipe 106. The outlet side of the check valve 121 is connected to a pipe connected to the gas-liquid separator 123. The check valve 121 allows the flow of the refrigerant in only one direction from the first connecting pipe 106 to the gas-liquid separator 123.

The check valves 118 to 121 described above constitute a flow switching valve of the refrigerant circuit. The flow switching valve and the relay device B described later enable formation of a refrigeration cycle for a cooling operation and a refrigerant cycle for a heating operation in the refrigerant circuit during the cooling and heating simultaneous operation.

The fourth flow regulator 122 has one end connected to the inlet side of the check valve 118 and an other end connected to the heat source device-side heat exchanger 103 and one of outlet sides of the gas-liquid separator 123. The outlet side of the check valve 118 is connected to one end of the second connecting pipe 107. An other end of the second connecting pipe 107 is connected to the relay device B.

The switching valve 125 has one end connected to the heat source device-side heat exchanger 103 and an other end connected to the fourth flow regulator 122.

With the connection configuration described above, each of the fourth flow regulator 122 and the switching valve 125 is connected in series to the relay device B to supply the refrigerant to the relay device B. The fourth flow regulator 122 is a flow control device having a variable opening degree.

Consequently, by regulating the opening degree of the fourth flow regulator 122, the amount of refrigerant flowing into the heat source device-side heat exchanger 103 is controlled to allow the refrigerant passing through the fourth flow regulator 122 to merge with the refrigerant passing through the switching valve 125 to supply the merged refrigerant to the relay device B.

The fifth flow regulator 124 is provided between the gas-liquid separator 123 and the accumulator 104, and has one end connected to one outlet side of the gas-liquid separator 123 and an other end connected to an inlet side of the accumulator 104. An other outlet side of the gas-liquid separator 123 is connected to the heat source device-side heat exchanger 103. Further, an inlet side of the gas-liquid separator 123 is connected to the outlet side of the check valve 121. The inlet side of the check valve 121 is connected to one end of the first connecting pipe 106. An other end of the first connecting pipe 106 is connected to the relay device B.

With the connection configuration described above, each of the fifth flow regulator 124 and the heat source device-side heat exchanger 103 is connected in series to the relay device B to be supplied with the refrigerant from the relay device B. The fifth flow regulator 124 is a flow control device having a variable opening degree.

Consequently, by regulating the opening degree of the fifth flow regulator 124, the amount of refrigerant flowing in from the relay device B is controlled to supply the refrigerant to the heat source device-side heat exchanger 103 under a state in which the amount of refrigerant is controlled.

Each of the pressure detecting units 126 and 127 is formed of, for example, a sensor. The first pressure detecting unit 126 is configured to measure a pressure of the refrigerant discharged from the compressor 101, and the second pressure detecting unit 127 is configured to measure a pressure of the refrigerant on the outlet side of the heat source device-side heat exchanger 103 (or on the inlet side of the compressor 101). The results of these measurements are sent to the control unit 141. The pressure detecting units 126 and 127 may directly send the results of the measurements to the control unit 141, or may store the results of the measurements for a given time period and then send the stored results of the measurements to the control unit 141 at predetermined periodic intervals.

The pressure detecting units 126 and 127 only need to be capable of detecting the pressure of the refrigerant, and kinds and other related factors of the pressure detecting units 126 and 127 are not limited.

Each of the temperature detecting units 128 and 129 is formed of, for example, a thermistor. The temperature detecting units 128 and 129 are configured to measure temperatures of the refrigerant on an inlet side and an outlet side of the heat source device-side heat exchanger 103 (inlet and outlet are interchanged depending on an operation mode). The results of those measurements are sent to the control unit 141. The temperature detecting units 128 and 129 may directly send the results of the measurements to the control unit 141, or may store the results of the measurements for a given time period and then send the stored results of the measurements to the control unit 141 at predetermined periodic intervals.

Although an example where each of the temperature detecting units 128 and 129 is formed of a thermistor is described above, the temperature detecting units are not particularly limited to a thermistor.

The control unit 141 is constituted mainly of, for example, a microprocessor unit, and is configured to perform collective control of the heat source device A and communication with an external device, for example, the relay device B based on the results of the measurements by the respective detecting units or other related factors. For the collective control of the heat source device A, computation processing necessary is executed.

The relay device B is provided with a first branch unit 110, a second branch unit 111, a gas-liquid separator 112, a second flow regulator 113, a third flow regulator 115, a first heat exchanger 116, a second heat exchanger 117, a temperature detecting unit 132, a third pressure detecting unit 130*a*, a fourth pressure detecting unit 130*b*, a control unit 151, and other components.

The relay device B is connected to the heat source device A via the first connecting pipe 106 and the second connecting pipe 107. Further, the relay device B is connected to the indoor unit C via the third connecting pipes 106*c* and the fourth connecting pipes 107*c*. Further, the relay device B is connected to the indoor unit D via the fifth connecting pipes 106*d* and the sixth connecting pipes 107*d*.

The first branch unit 110 includes electromagnetic valves 108*a* and electromagnetic valves 108*b*. The electromagnetic valves 108*a* and the electromagnetic valves 108*b* are connected to the indoor unit C via the third connecting pipes 106*c*. Further, the electromagnetic valves 108*a* and the electromagnetic valves 108*b* are connected to the indoor unit D via the fifth connecting pipes 106*d*.

The electromagnetic valves 108*a* are openable and closable valves, and have one ends connected to the first connecting pipe 106 and other ends each connected to a corresponding one of the third connecting pipes 106*c* and the fifth connecting pipes 106*d*, and terminals at one side of the electromagnetic valves 108*b*. The electromagnetic valves 108*b* are openable and closable valves, and have one ends connected to the second connecting pipe 107 including the gas-liquid separator 112 and other ends each connected to a corresponding one of the third connecting pipes 106*c* and the fifth connecting pipes 106*d*, and terminals at one side of the electromagnetic valves 108*a*.

The first branch unit 110 is connected to the indoor unit C via the third connecting pipes 106*c*. The first branch unit 110 is connected to the indoor unit via the fifth connecting pipes 106*d*. The first branch unit 110 is connected to the heat source device A via the first connecting pipe 106 and the second connecting pipe 107. The first branch unit 110 uses the electromagnetic valves 108*a* and the electromagnetic valves 108*b* to connect each of the third connecting pipes 106*c* to a corresponding one of the first connecting pipe 106 and the second connecting pipe 107. The first branch unit 110 uses the electromagnetic valves 108*a* and the electromagnetic valves 108*b* to connect each of the fifth connecting pipes 106*d* to a corresponding one of the first connecting pipe 106 and the second connecting pipe 107.

The second branch unit 111 includes check valves 131*a* and check valves 131*b*. The check valves 131*a* and the check valves 131*b* are connected in anti-parallel with each other. Input sides of the check valves 131*a* and output sides of the check valves 131*b* are connected to the indoor unit C via the fourth connecting pipes 107*c*, and are connected to the indoor unit D via the sixth connecting pipes 107*d*. Output sides of the check valves 131*a* are connected to a joining portion 131*a*_all. Input sides of the check valves 131*b* are connected to a joining portion 131*b*_all. The joining portion 131*a*_all and the joining portion 131*b*_all are clearly illustrated in FIG. 2 and FIG. 3.

The second branch unit 111 is connected to the indoor unit C via the fourth connecting pipes 107*c*. The second branch unit 111 is connected to the indoor unit D via the sixth connecting pipes 107*d*. The second branch unit 111 is connected to the second flow regulator 113 and the first heat exchanger 116 via the joining portion 131*a*_all. The second branch unit 111 is connected to the third flow regulator 115 and the first heat exchanger 116 via the joining portion 131*b*_all.

The gas-liquid separator 112 is provided in the middle of the second connecting pipe 107, and includes a gas-phase portion connected to the electromagnetic valves 108*b* of the first branch unit 110 and a liquid-phase portion connected to the second branch unit 111 via the first heat exchanger 116, the second flow regulator 113, and the second heat exchanger 117.

The second flow regulator 113 has one end connected to the first heat exchanger 116 and an other end connected to one end of the second heat exchanger 117 and the joining portion 131*a*_all of the second branch unit 111. The third pressure detecting unit 130*a* is provided to a pipe between the first heat exchanger 116 and the second flow regulator 113. The fourth pressure detecting unit 130*b* is provided to a pipe between the second flow regulator 113, and the second heat exchanger 117 and the joining portion 131*a*_all.

The second flow regulator 113 is a flow regulator having a regulatable opening degree, and is configured to regulate the opening degree so that a difference between a pressure value detected by the third pressure detecting unit 130*a* and a pressure value detected by the fourth pressure detecting unit 130*b* becomes constant.

The third flow regulator 115 has one end connected to a bypass pipe 114 side of the second heat exchanger 117 and an other end connected to a pipe side that connects the joining portion 131*b*_all and the second heat exchanger 117. The third flow regulator 115 is a flow regulator having a regulatable opening degree. The opening degree of the third flow regulator 115 is regulated by any one of the temperature detecting unit 132, the third pressure detecting unit 130*a*, and the fourth pressure detecting unit 130*b*, or a combination of these detecting units.

Further, the bypass pipe 114 has one end connected to the first connecting pipe 106 and an other end connected to the third flow regulator 115.

Consequently, the amount of refrigerant supplied to the heat source device A varies depending on the opening degree of the third flow regulator 115.

The first heat exchanger 116 is provided between the gas-liquid separator 112, and the second heat exchanger 117 and the second flow regulator 113, and is configured to exchange heat between the bypass pipe 114 and a pipe provided between the gas-liquid separator 112 and the second flow regulator 113.

The second heat exchanger 117 is provided between the first heat exchanger 116 and one end of the third flow regulator 115 and between the second flow regulator 113 and an other end of the third flow regulator 115. The other end of the third flow regulator 115 in this case is a side connected to the joining portion 131*b*_all. The second heat exchanger 117 exchanges heat between the bypass pipe 114 and a pipe provided between the second flow regulator 113 and the third flow regulator 115.

The temperature detecting unit 132 is formed of, for example, a thermistor. The temperature detecting unit 132 is configured to measure a temperature of the refrigerant at an outlet of the second heat exchanger 117, specifically, the refrigerant flowing in a pipe provided on a downstream side of the second heat exchanger 117, and send the result of the measurement to the control unit 151. The temperature detecting unit 132 may directly send the result of the measurement to the control unit 151, or may store the result of the measurement for a given period of time and then send the result of the measurement to the control unit 151 at predetermined periodic intervals.

Although an example where the temperature detecting unit 132 is formed of a thermistor is described above, the temperature detecting unit is not particularly limited to a thermistor.

The third pressure detecting unit 130*a* is configured to measure a pressure of the refrigerant flowing in a pipe provided between the first heat exchanger 116 and the second flow regulator 113 to send the result of the measurement to the control unit 151.

The fourth pressure detecting unit 130*b* is configured to measure a pressure of the refrigerant flowing in a pipe provided between the second flow regulator 113, and the second heat exchanger 117 and the second branch unit 111 to send the result of the measurement to the control unit 151.

The third pressure detecting unit 130*a* and the fourth pressure detecting unit 130*b* are collectively referred to as "pressure detecting unit 130". The pressure detecting unit 130 may directly send the result of the measurement to the control unit 151, or may store the result of the measurement for a given period of time and then send the stored result of the measurement to the control unit 151 at predetermined periodic intervals. The pressure detecting unit 130 only needs to be capable of detecting the pressure of the refrigerant, and kinds and other related factors of the pressure detecting unit 130 are not limited.

The control unit 151 is constituted mainly of, for example, a microprocessor unit, and is configured to perform collective control of the relay device B and communication with an external device, for example, the heat source device A or the indoor units C and D based on the results of the measurements by the respective detecting units or other related factors. For the collective control of the relay device B, computation processing necessary is executed.

Figure 2:
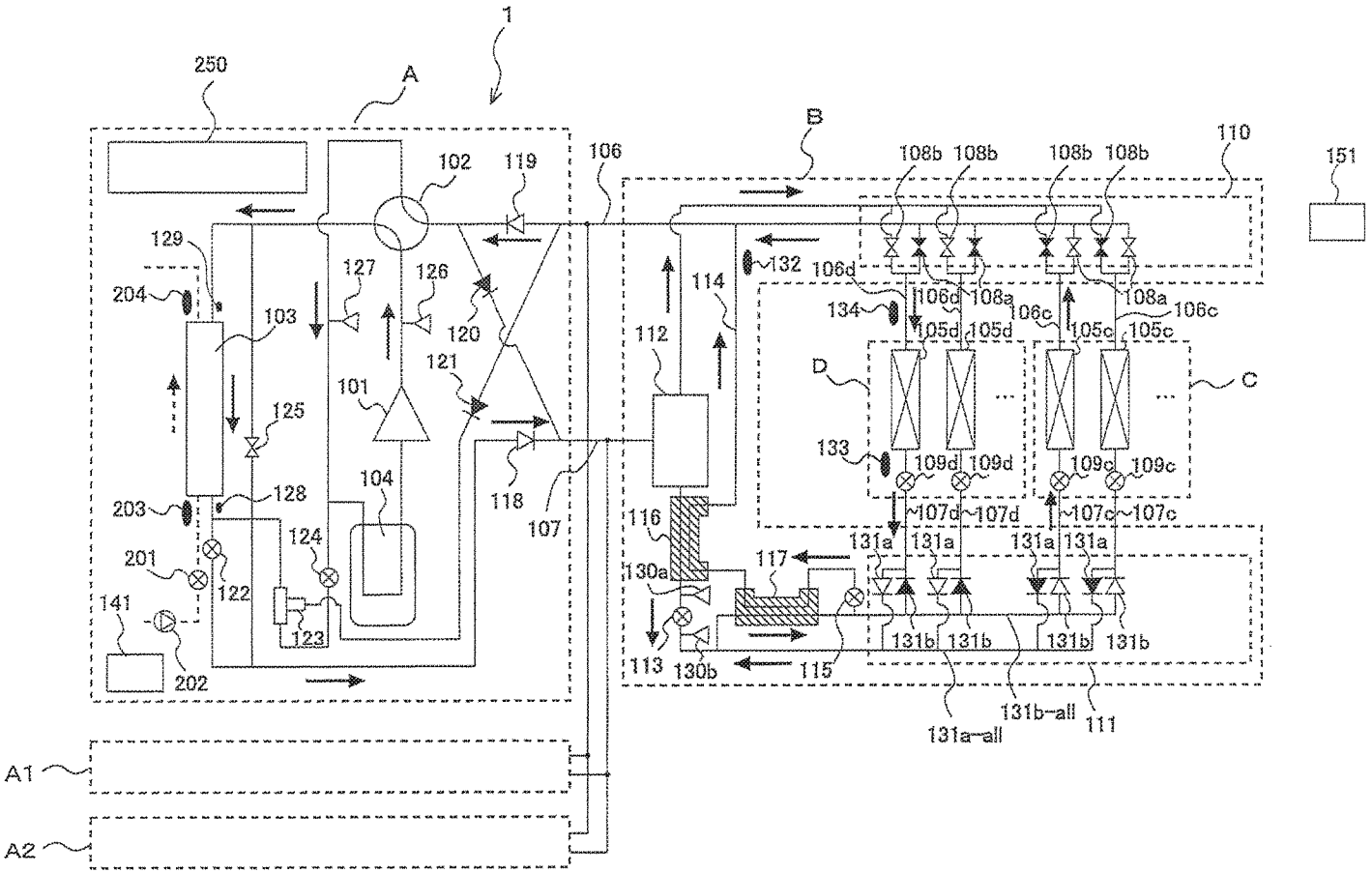
FIG. 2 is a diagram for illustrating a configuration example of an air-conditioning apparatus 1 and for illustrating an operating state in a case where cooling is mainly performed during a cooling and heating simultaneous operation according to Embodiment 1 of the present invention.
Figure 3:
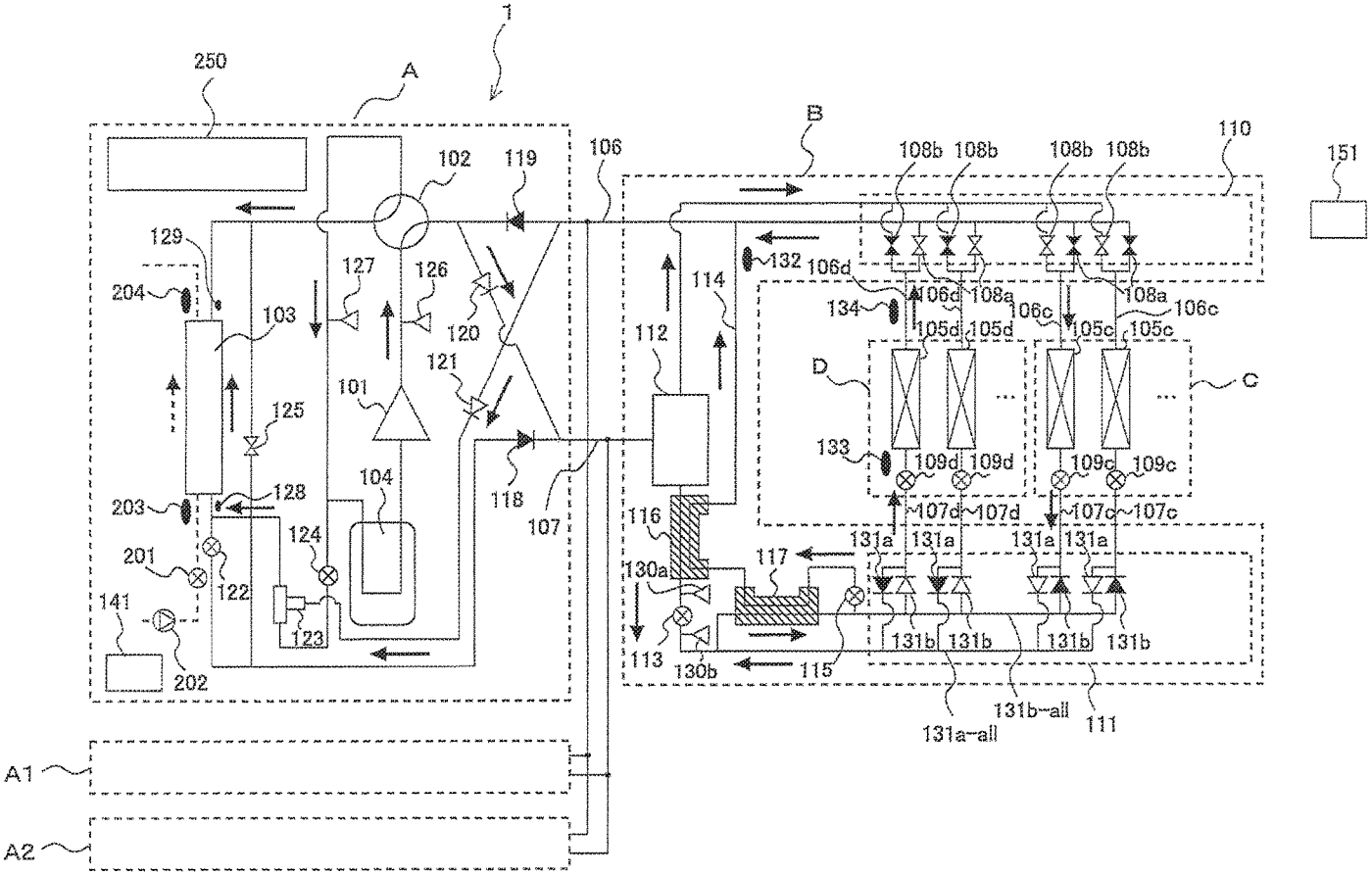
FIG. 3 is a diagram for illustrating a configuration example of the air-conditioning apparatus 1 and for illustrating an operating state in a case where heating is mainly performed during the cooling and heating simultaneous operation according to Embodiment 1 of the present invention.

The indoor unit C includes the use-side heat exchangers 105*c* and first flow regulators 109*c*. A plurality of the use-side heat exchangers 105*c* may be provided. A liquid-pipe temperature detecting unit 133 configured to detect a temperature of a pipe is provided between the use-side heat exchangers 105*c* and the first flow regulators 109*c*. Further, a gas-pipe temperature detecting unit 134 configured to detect a temperature of a pipe is provided between the use-side heat exchangers 105*c* and the first branch unit 110. Although the liquid-pipe temperature detecting unit 133 and the gas-pipe temperature detecting unit 134 are illustrated in FIG. 1 to FIG. 3 only for one of the use-side heat exchangers 105*d* of the indoor unit D because of space limitations, these temperature detecting units are provided to each of all the use-side heat exchangers of the indoor unit C and the indoor unit D.

The use-side heat exchangers 105*c* and the first flow regulators 109*c* described above constitute a part of the refrigerant circuit.

The indoor unit D includes the use-side heat exchangers 105*d* and first flow regulators 109*d*. A plurality of the use-side heat exchangers 105*d* may be provided. The liquid-pipe temperature detecting unit 133 configured to detect a temperature of a pipe is provided between the use-side heat exchangers 105*d* and the first flow regulators 109*d*. Further, the gas-pipe temperature detecting unit 134 configured to detect a temperature of a pipe is provided between the use-side heat exchangers 105*d* and the first branch unit 110.

The use-side heat exchangers 105*d* and the first flow regulators 109*d* described above constitute a part of the refrigerant circuit.

Next, a heat medium system included in the heat source device A is described. Although an example where the heat medium system is included in the heat source device A is described in this embodiment, the heat medium system may be entirely or partially installed outside of the heat source device A.

The heat medium system is configured to supply a heat medium that is different from the refrigerant, may be, e.g., water or brine, and exchanges heat with the refrigerant flowing through the heat source device-side heat exchanger 103 to the heat source device-side heat exchanger 103. Components of the system include a heat-medium flow regulator 201, a heat-medium conveying device 202, a heat-medium inflow temperature detecting unit 203, a heat-medium outflow temperature detecting unit 204, and a heat-medium flow control device 250. The heat medium system is generally configured to also regulate a temperature of the heat medium.

The heat-medium flow regulator 201 is configured to regulate a flow rate of the heat medium flowing through the heat source device-side heat exchanger 103, and is constituted of a valve or other devices. The heat-medium conveying device 202 is configured to deliver the heat medium, and is constituted of a pump or other devices. The heat-medium inflow temperature detecting unit 203 and the heat-medium outflow temperature detecting unit 204 are temperature sensors configured to each measure a corresponding one of temperatures of the heat medium on an inlet side and an outlet side of the heat source device-side heat exchanger 103. The heat-medium flow regulator 201 and the heat-medium conveying device 202 are controlled by the heat-medium flow control device 250 based on values detected by the heat-medium inflow temperature detecting unit 203 and the heat-medium outflow temperature detecting unit 204, and other values.

The heat-medium flow control device 250 includes a heat source device operation mode detecting unit 205 configured to determine whether the compressors of the heat source device A and the combined heat source devices are in a stopped state or are operating, and an indoor unit operation mode detecting unit 210 configured to detect a sum of indoor unit cooling operation capacities that is a sum of capacities of the plurality of use-side heat exchangers 105 performing the cooling operation, and a sum of indoor unit heating operation capacities that is a sum of capacities of the plurality of use-side heat exchangers 105 performing the heating operation. The heat-medium flow control device 250 further includes a heat-medium temperature difference computing unit 251 configured to calculate a difference between a value measured by the heat-medium inflow temperature detecting unit 203 and a value measured by the heat-medium outflow temperature detecting unit 204.

The heat-medium flow control device 250 is configured to calculate a flow rate of the heat medium supplied to the heat source device-side heat exchanger 103 based on the result obtained by the heat-medium temperature difference computing unit 251.

Further, the heat-medium flow control device 250 uses the heat source device operation mode detecting unit 205 and the indoor unit operation mode detecting unit 210 to calculate the flow rate of the heat medium supplied to the heat source device-side heat exchanger 103 from the sum of the indoor unit cooling operation capacities, the sum of the indoor unit heating operation capacities, and the sum of operation capacities of the heat source device A and the combined heat source devices (total operation capacity of the heat source devices).

In addition, the heat-medium flow control device 250 includes setting switches 252 through which a flow rate value of the heat medium can be input.

The heat-medium flow control device 250 may be included in the control unit 141 of the heat source device A.

FIG. 2 is a diagram for illustrating a configuration example of the air-conditioning apparatus 1 and for illustrating an operating state in which the cooling is mainly performed during the cooling and heating simultaneous operation according to Embodiment 1 of the present invention.

Preconditions here are that the cooling operation is set for the indoor unit C, the heating operation is set for the indoor unit D, and the air-conditioning apparatus 1 is operated mainly for cooling.

In the first branch unit 110, the electromagnetic valves 108*a* on the indoor unit C side are opened and the electromagnetic valves 108*a* on the indoor unit D side are closed. Further, in the first branch unit 110, the electromagnetic valves 108*b* on the indoor unit C side are closed and the electromagnetic valves 108*b* on the indoor unit D side are opened.

The opening degree of the second flow regulator 113 is controlled so that a differential pressure between the pressure measured by the third pressure detecting unit 130*a* and the pressure measured by the fourth pressure detecting unit 130*b* becomes an appropriate value.

Flow of the refrigerant in this case is described. As indicated by the solid arrows, high-temperature and high-pressure gas refrigerant compressed in and discharged from the compressor 101 passes through the four-way valve 102 to flow into the heat source device-side heat exchanger 103.

The heat source device-side heat exchanger 103 exchanges heat with the heat medium, e.g., water. The high-temperature and high-pressure gas refrigerant after the heat exchange turns into high-temperature and high-pressure two-phase gas-liquid refrigerant. Next, the high-temperature and high-pressure two-phase gas-liquid refrigerant passes through the fourth flow regulator 122, the check valve 118, and the second connecting pipe 107 to be supplied to the gas-liquid separator 112 of the relay device B. At this time, the switching valve 125 is controlled to a predetermined opening degree depending on a difference between the temperature obtained from the pressure value detected by the first pressure detecting unit 126 and its target value.

The gas-liquid separator 112 separates the high-temperature and high-pressure two-phase gas-liquid refrigerant into gaseous refrigerant and liquid refrigerant.

The separated gaseous refrigerant flows into the first branch unit 110. The gaseous refrigerant flowing into the first branch unit 110 is supplied to the indoor unit D set to perform the heating operation via the electromagnetic valves 108*b* that are open and the fifth connecting pipes 106*d*.

In the indoor unit D, the use-side heat exchangers 105*d* exchange heat with a use-side medium, e.g., air, to condense and liquefy the supplied gaseous refrigerant.

Further, the use-side heat exchangers 105*d* are controlled by the first flow regulators 109*d* based on degrees of subcooling at the outlets of the use-side heat exchangers 105*d*.

The first flow regulators 109*d* reduce a pressure of the liquid refrigerant condensed and liquefied in the use-side heat exchangers 105*d* to obtain refrigerant at an intermediate pressure that is a pressure between a high pressure and a low pressure.

The refrigerant having the reduced intermediate pressure flows into the second branch unit 111.

At this time, the first connecting pipe 106 is at a low pressure, whereas the second connecting pipe 107 is at a high pressure. Thus, due to a pressure difference between the two pipes, the refrigerant flows through the check valve 118 and the check valve 119, whereas the refrigerant does not flow through the check valve 120 and the check valve 121.

On the other hand, the liquid refrigerant separated in the gas-liquid separator 112 passes through the second flow regulator 113 configured to control the differential pressure between the high pressure and the intermediate pressure becomes constant, to flow into the second branch unit 111.

Next, in the second branch unit 111, the supplied liquid refrigerant passes through the check valves 131*b* connected to the indoor unit C side and the fourth connecting pipes 107*c* to flow into the indoor unit C.

Next, the liquid refrigerant flowing into the indoor unit C is supplied to the use-side heat exchangers 105*c* under a state in which a pressure is reduced to a low pressure by using the first flow regulators 109*c* controlled depending on degrees of superheat at outlets of the use-side heat exchangers 105*c* of the indoor unit C.

In the use-side heat exchangers 105*c*, the supplied liquid refrigerant exchanges heat with the use-side medium, e.g., air, to be vaporized and gasified.

The refrigerant gasified into gas refrigerant passes through the third connecting pipes 106*c* to flow into the first branch unit 110. In the first branch unit 110, the electromagnetic valves 108*a* on the side connected to the indoor unit C are open. Thus, the gas refrigerant flowing into the first branch unit 110 passes through the electromagnetic valves 108*a* on the side connected to the indoor unit C to flow into the first connecting pipe 106.

Next, the gas refrigerant flows toward the check valve 119 having a pressure lower than that of the check valve 121 to be sucked into the compressor 101 via the four-way valve 102 and the accumulator 104.

By the operation described above, a refrigeration cycle is formed to perform a cooling main operation.

Part of the liquid refrigerant separated in the gas-liquid separator 112 and flowing into the second branch unit 111 does not flow into the indoor unit C. Such refrigerant passes through the second flow regulator 113, and the second heat exchanger 117 to flow into the third flow regulator 115, without flowing into the second branch unit 111. The third flow regulator 115 reduces a pressure of the liquid refrigerant flowing into the third flow regulator 115 to a low pressure to lower an evaporating temperature of the refrigerant. While the liquid refrigerant decreasing in the evaporating temperature passes through the bypass pipe 114, the refrigerant exchanges heat with the liquid refrigerant mainly supplied from the second flow regulator 113 to be turned into two-phase gas-liquid refrigerant in the second heat exchanger 117 and exchanges heat with the high-temperature and high-pressure liquid refrigerant supplied from the gas-liquid separator 112 to be turned into gas refrigerant in the first heat exchanger 116 to flow into the first connecting pipe 106.

FIG. 3 is a diagram for illustrating a configuration example of the air-conditioning apparatus 1 and for illustrating an operating state in which the heating is mainly performed during the cooling and heating simultaneous operation according to Embodiment 1 of the present invention.

Preconditions here are that the heating operation is set for the indoor unit C, the cooling operation is set for the indoor unit D, and the air-conditioning apparatus 1 is operated mainly for heating.

In the first branch unit 110, the electromagnetic valves 108*a* on the indoor unit C side are closed and the electromagnetic valves 108*a* on the indoor unit D side are opened. Further, in the first branch unit 110, the electromagnetic valves 108*b* on the indoor unit C side are opened and the electromagnetic valves 108*b* on the indoor unit D side are closed.

The opening degree of the second flow regulator 113 is controlled so that a differential pressure between the pressure measured by the third pressure detecting unit 130*a* and the pressure measured by the fourth pressure detecting unit 130*b* becomes an appropriate value.

Flow of the refrigerant in this case is described. As indicated by the thick solid arrows, high-temperature and high-pressure gas refrigerant compressed in and discharged from the compressor 101 passes through the four-way valve 102, the check valve 120, and the second connecting pipe 107 to be supplied to the gas-liquid separator 112 of the relay device B.

The gas-liquid separator 112 supplies the high-temperature and high-pressure gas refrigerant to the first branch unit 110. The gas refrigerant supplied to the first branch unit 110 is supplied to the indoor unit C set to perform a heating operation via the electromagnetic valves 108*b* that are open and the third connecting pipes 106*c*.

In the indoor unit C, the use-side heat exchangers 105*c* exchange heat with a use-side medium, e.g., air, to condense and liquefy the supplied gaseous refrigerant.

Further, the use-side heat exchangers 105*c* are controlled by the first flow regulators 109*c* based on degrees of subcooling at the outlets of the use-side heat exchangers 105*c*.

The first flow regulators 109*c* reduce a pressure of the liquid refrigerant that is condensed and liquefied in the use-side heat exchangers 105*c* to obtain liquid refrigerant at an intermediate pressure that is a pressure between a high pressure and a low pressure.

The liquid refrigerant having the reduced intermediate pressure passes through the fourth connecting pipes 107*c* to flow into the second branch unit 111.

Next, the liquid refrigerant flowing into the second branch unit 111 merges in the joining portion 131*a*_all. The liquid refrigerant merging in the joining portion 131*a*_all passes through the second heat exchanger 117. At this time, part of the liquid refrigerant that first passes through the second heat exchanger 117 passes through the third flow regulator 115 to flow into the second heat exchanger 117 under a pressure-reduced state. Thus, in the second heat exchanger 117, the intermediate-pressure liquid refrigerant and the low-pressure liquid refrigerant exchange heat with each other. The low-pressure liquid refrigerant has a low evaporating temperature, and is thus turned into the gas refrigerant. The gas refrigerant passes through the bypass pipe 114, to flow into the first connecting pipe 106. On the other hand, the intermediate-pressure liquid refrigerant reaches the joining portion 131*b*_all and passes through the check valves 131*b* connected to the indoor unit D and the sixth connecting pipes 107*d* to flow into the indoor unit D.

Next, the liquid refrigerant flowing into the indoor unit D is supplied to the use-side heat exchangers 105*d* under a state in which a pressure is reduced to a low pressure so that the refrigerant has a low evaporating temperature by using the first flow regulators 109*d* controlled depending on degrees of superheat at the outlets of the use-side heat exchangers 105*d* of the indoor unit D.

In the use-side heat exchangers 105*d*, the supplied liquid refrigerant having the low evaporating temperature exchanges heat with the use-side medium, e.g., air, to be vaporized and gasified.

The refrigerant gasified into gas refrigerant passes through the fifth connecting pipes 106*d* to flow into the first branch unit 110. In the first branch unit 110, the electromagnetic valves 108*a* on the side connected to the indoor unit D are open. Thus, the gas refrigerant flowing into the first branch unit 110 passes through the electromagnetic valves 108*a* on the side connected to the indoor unit D to flow into the first connecting pipe 106.

Next, the gas refrigerant flows toward the check valve 121 having a pressure lower than that of the check valve 119, and the liquid refrigerant passing through the gas-liquid separator 123 flows into the heat source device-side heat exchanger 103 to be evaporated and gasified to be sucked into the compressor 101 via the four-way valve 102 and the accumulator 104. The gas refrigerant passing through the gas-liquid separator 123 passes through the fifth flow regulator 124 to be sucked into the compressor 101 via the accumulator 104.

By the operation described above, a refrigeration cycle is formed to perform a heating main operation.

At this time, the first connecting pipe 106 is at the low pressure, whereas the second connecting pipe 107 is at the high pressure. Thus, due to a pressure difference between the two pipes, the refrigerant flows through the check valve 120 and the check valve 121, whereas the refrigerant does not flow through the check valve 118 and the check valve 119.

Next, in the above-mentioned configuration, a ratio of the cooling operation capacity and the heating operation capacity is assumed to change when the cooling main operation is performed during the cooling and heating simultaneous operation.

As the heating operation capacity increases, a quality (dryness) is required to be set large as a state of the refrigerant flowing into the relay device B. As a result, the condensing temperature, specifically, a high pressure of the heat source device-side heat exchanger 103 included in the heat source device A decreases. Due to this phenomenon, the liquid-pipe temperature detected by the liquid-pipe temperature detecting unit 133 of the indoor unit C performing the cooling operation decreases. As a result, the indoor unit C is repeatedly started and stopped. Hence, the air-conditioning apparatus 1 cannot maintain a continuous cooling operation. Further, the condensing temperature is low, and thus heating capability is lowered. Consequently, a user using the air-conditioning apparatus 1 feels uncomfortable.

To prevent the start and stop of the indoor unit C, the liquid-pipe temperature detected by the liquid-pipe temperature detecting unit 133 of the indoor unit C is required to be increased to a predetermined value or higher. However, the liquid-pipe temperature detected by the liquid-pipe temperature detecting unit 133 of the indoor unit C differs in each of the use-side heat exchangers 105*c* of the indoor unit C. Thus, when processing of increasing the liquid pipe temperature is performed, the liquid-pipe temperature needs to be controlled individually for each of the use-side heat exchangers 105*c*. Thus, the control is complicated.

Further, to ensure the heating capability, the condensing temperature, specifically, the high pressure of the heat source device-side heat exchanger 103 is required to be set to a predetermined value.

Consequently, the amount of refrigerant flowing through the heat source device-side heat exchanger 103 and the amount of refrigerant bypassing the heat source device-side heat exchanger 103 via the switching valve 125 are determined by a ratio of the cooling operation capacity (indoor unit C) and the heating operation capacity (indoor unit D).

Figure 4:
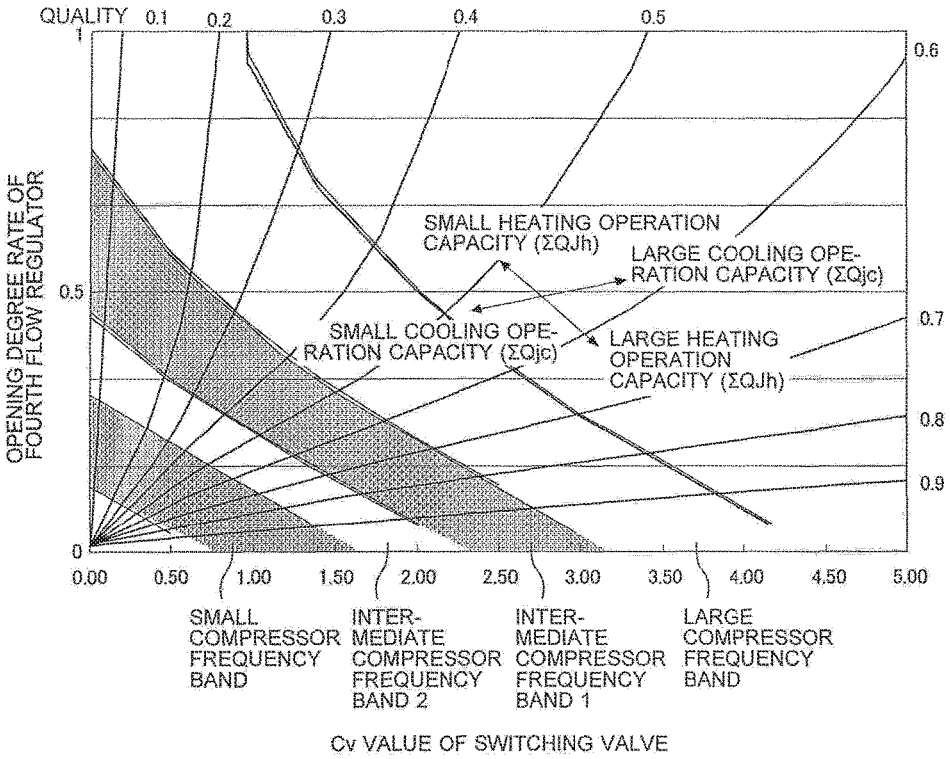
FIG. 4 is a graph for showing an example of a relationship between a Cv value of a switching valve 125 and an opening degree rate of a fourth flow regulator 122 during cooling according to Embodiment 1 of the present invention.

FIG. 4 is a graph for showing an example of a relationship between a Cv value of the switching valve 125 and an opening degree rate of the fourth flow regulator 122 during the cooling according to Embodiment 1 of the present invention.

Assumptions here are that the horizontal axis indicates the Cv value of the switching valve 125 and the longitudinal axis indicates the opening degree rate of the fourth flow regulator 122 configured to control the flow rate of the heat source device-side heat exchanger 103. Further, ΣQjc is a total heat quantity during cooling, and ΣQjh is a total heat quantity during heating in the assumptions.

As shown in FIG. 4, when the ratio of the indoor unit D increases to be greater than that of the indoor unit C during the cooling main operation, the pressure detected by the first pressure detecting unit 126 is lowered. Thus, the quality of the refrigerant is required to be increased. When the ratio of the indoor unit C and that of the indoor unit D are the same, the quality is to move on the same quality line. A compressor frequency is determined by the total heat quantity during cooling ΣQjc, whereas the Cv value of the switching valve 125 is determined by the total heat quantity during heating ΣQjh.

The opening degree of the fourth flow regulator 122 is determined by a value measured by the first pressure detecting unit 126 and values measured by the refrigerant temperature detecting units 128 and 129 at the outlet and the inlet of the heat source device-side heat exchanger 103. Further, in an area in which the flow rate of the refrigerant flowing in the heat source device-side heat exchanger 103 is large, the degree of subcooling decreases to increase the quality at the outlet of the heat source device-side heat exchanger 103. Consequently, a characteristic line for the switching valve 125 has an upward inclination from the left to the right.

Specifically, in the above-mentioned case, a difference between a temperature obtained from the pressure detected by the first pressure detecting unit 126 and a target control temperature only needs to be controlled by the Cv value of the switching valve 125, the opening degree ratio of the fourth flow regulator 122, and the frequency of the compressor 101. Owing to this operation, the target control temperature is not required to be determined individually for each of the temperatures of the indoor units, and only needs to be controlled based on the detection result of the first pressure detecting unit 126 of the heat source device A.

Consequently, the control is facilitated to enable continuation of a stable cooling and heating simultaneous operation.

Although the case where the ratio of the indoor unit D increases is described above, a case where the ratio of the indoor unit D decreases can be treated in a similar manner. Thus, when the ratio of the indoor unit D decreases, the temperature detected by the first pressure detecting unit 126 of the heat source device A increases. Specifically, processing inverse to the above-mentioned processing only needs to be performed.

From the description given above, by increasing the switching valve 125 configured to open and close a bypass circuit configured to bypass the fourth flow regulator configured to control the flow rate of the heat source device-side heat exchanger 103 of the heat source device A and the heat source device-side heat exchanger 103 to control the pressure detected by the first pressure detecting unit 126 included in the heat source device A, even when each of a plurality of use-side heat exchangers 105 performs the cooling operation or the heating operation during the cooling and heating simultaneous operation, stable control can be easily performed. Consequently, comfort can be maintained at low cost.

As described above, in Embodiment 1, the air-conditioning apparatus 1 includes the heat source device-side heat exchanger 103, the plurality of use-side heat exchangers 105, the relay device B provided between the heat source device-side heat exchanger 103 and the plurality of use-side heat exchangers 105 and configured to switch at least one of the plurality of use-side heat exchangers 105 to the cooling operation and switch the others of the plurality of use-side heat exchangers 105 to the heating operation, the fourth flow regulator 122 configured to regulate the flow rate of the refrigerant flowing into the heat source device-side heat exchanger 103, the switching valve 125 arranged in the passage that bypasses the heat source device-side heat exchanger 103, and the control unit 141 configured to regulate the opening degree of the fourth flow regulator 122 and the Cv value of the switching valve 125. The air-conditioning apparatus 1 is configured to switch each of the plurality of use-side heat exchangers 105 to the cooling operation or the heating operation in accordance with a control command to perform the cooling and heating simultaneous operation. The target control temperature of the heat source device-side heat exchanger 103 is obtained based on the inlet pressure of the heat source device-side heat exchanger 103 (discharge pressure of the compressor 101), the inlet temperature and the outlet temperature of the refrigerant at the heat source device-side heat exchanger 103, and the ratio of the cooling operation capacity and the heating operation capacity of the plurality of use-side heat exchangers 105, and the opening degree of the fourth flow regulator 122 and the Cv value of the switching valve 125 are regulated depending on the target control temperature to control the flow rate of the heat source device-side heat exchanger 103. In this manner, even when the plurality of use-side heat exchangers are performing the cooling operation during the cooling and heating simultaneous operation, the control for performing the cooling operation or the heating operation can be simplified. With this configuration, the stable cooling and heating simultaneous operation can be continued at low cost.

Embodiment 2

Figure 5:
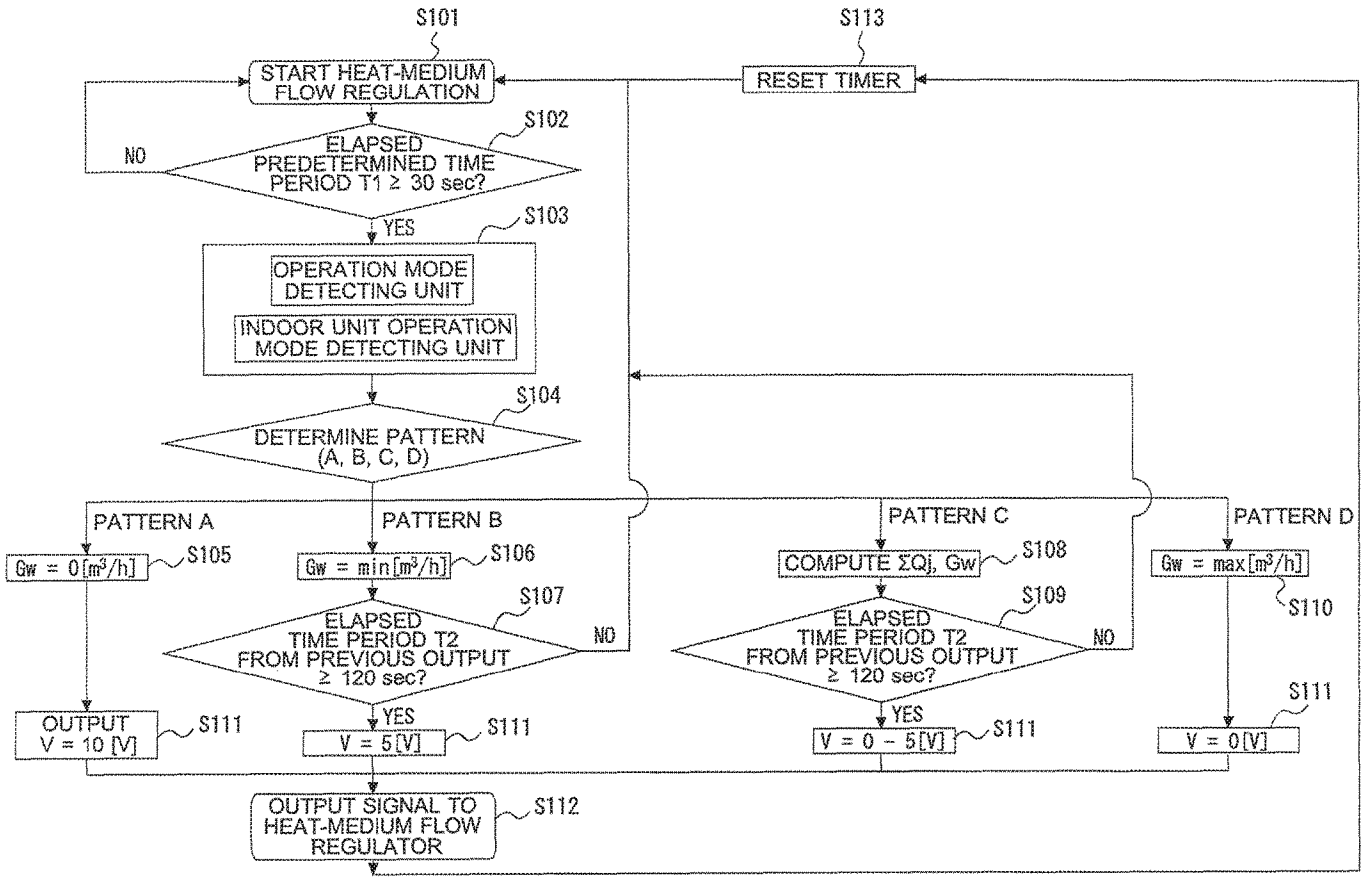
FIG. 5 is a diagram for illustrating an example of a flowchart of heat medium flow regulation control according to Embodiment 2 of the present invention.

FIG. 5 is a diagram of a flowchart for illustrating a flow of heat-medium flow regulation control performed by the heat-medium flow control device 250 according to Embodiment 2 of the present invention. With reference to FIG. 5, a flow, by the heat-medium flow control device 250, from acquisition of input values to output of an electric signal to the heat-medium flow regulator 201 is described.

When the heat source device A is in a state ready for operation, the heat medium flow regulation is started (Step S101). After the start of the heat medium flow regulation, whether or not a predetermined time period T1 (seconds) (30 seconds in this case) has elapsed is determined (Step S102). When the predetermined time period T1 (seconds) has elapsed, the control proceeds to acquire input values necessary for the heat-medium flow regulation. As the input values, an operating state of the heat source device A (whether the compressor 101 is in a stopped state or is operating) detected by the heat source device operation mode detecting unit 205 and the heat medium temperature difference obtained from the heat-medium temperature difference computing unit 251 based on the values measured by the heat-medium inflow temperature detecting unit 203 and the heat-medium outflow temperature detecting unit 204 are acquired (Step S103). Subsequently, the heat-medium flow control device 250 determines a pattern (patterns A, B, C, and D) of the heat-medium flow regulation state by using the relationship shown in FIG. 6 from the operating state of the heat source device A (Step S104).

In a pattern A (zero flow rate), the compressor 101 of the heat source device A is in a stopped state and the compressors of the combined heat source devices are all in a stopped state. Thus, the heat medium does not have to be supplied to the heat source device-side heat exchanger 103, and a necessary flow rate of the heat medium Gw becomes 0 [$m^3$/h] (Step S105). After calculation of the necessary flow rate of the heat medium, the necessary flow rate of the heat medium is output to the heat-medium flow regulator 201 as an electric signal. Because assumptions here are that a voltage signal is set within a range of from 0 V to 10 V, 0 V corresponds to full opening, and 10 V corresponds to full closure, 10 V is output (Step S111). Although 0 V may be associated with the full closure and 10 V may be associated with the full opening, 0 V is preferred to be associated with the full opening and 10 V is preferred to be associated with the full closure in terms of safety.

Although the description herein is based on an assumption that the voltage signal is used, a current signal may be used.

In a pattern B (lower limit flow rate), the compressor 101 of the heat source device A is in a stopped state and one or more compressors of the combined heat source devices are in an operating state. Thus, to prevent freezing of the heat source device-side heat exchanger 103 for which the compressor 101 is stopped, a lower limit flow rate defined by the heat source device A is supplied to the heat source device-side heat exchanger 103 as the heat medium (Step S106). After the calculation of the necessary flow rate of the heat medium, the necessary flow rate of the heat medium is output to the heat-medium flow regulator 201 as an electric signal. In consideration of an opening and closing speed of the heat-medium flow regulator 201, an elapsed time period from the previous output and a predetermined time period T2 (seconds) (120 seconds in this case) are compared with each other. When the elapsed time period from the previous output is equal to or longer than the predetermined time period T2 (seconds) (Step S107, YES), the electric signal is output to the heat-medium flow regulator 201. Because assumptions here are that the voltage signal is set within a range of from 0 V to 10 V, 0 V corresponds to the full opening, and 10 V corresponds to the full closure, the output is between 0 V to 10 V, but the output electric signal is assumed to be 5 V in this case (Step S111). On the other hand, when the elapsed time period from the previous output is shorter than the predetermined time period T2 (seconds) (Step S107, NO), the control returns to the start of the heat-medium flow regulation (Step S101) to perform the steps again.

In a pattern C (computed flow rate), the compressor 101 of the heat source device A is in an operating state and a compressor operating time period is equal to or longer than a predetermined time period T0 (minutes) (5 minutes in this case). Thus, the flow rate of the heat medium Gw to be supplied to the heat source device-side heat exchanger 103 is computed (Step S108). After the calculation of the necessary flow rate of the heat medium, the necessary flow rate of the heat medium is output to the heat-medium flow regulator 201 as an electric signal. In consideration of the opening and closing speed of the heat-medium flow regulator 201, the elapsed time period from the previous output and the predetermined time period T2 (seconds) (120 seconds in this case) are compared with each other. When the elapsed time period from the previous output is equal to or longer than the predetermined time period T2 (seconds) (Step S109, YES), the electric signal is output to the heat-medium flow regulator 201. Because assumptions here are that the voltage signal is set within a range of from 0 V to 10 V, 0 V corresponds to the full opening, 10 V corresponds to the full closure, and the lower limit flow rate is 5 V, the electric signal between 0 V and 5 V is output (Step S111). On the other hand, when the elapsed time period from the previous output is shorter than the predetermined time period T2 (seconds) (Step S109, NO), the control returns to the start of the heat-medium flow regulation (Step S101) to perform the steps again.

The "flow rate of the heat medium Gw" in the pattern C is calculated by the heat-medium flow control device 250 from the expression shown in FIG. 6 by using a total capacity of the use-side heat exchangers 105 performing the cooling operation (sum of the indoor unit cooling operation capacities), a total capacity of the use-side heat exchangers 105 performing the heating operation (sum of the indoor unit heating operation capacities), a total operation capacity (heat source device operation capacity) of the heat source device-side heat exchanger 103, and a rated flow rate Gwmax.

The above-mentioned flow rate of the heat medium Gw applies to a case where the number of heat-medium flow regulators 201 is one, including those of the combined heat sources. When each of the heat source devices of the combined heat sources includes the heat-medium flow regulator 201, a flow rate of the heat medium of each of the heat source devices becomes Gw/n (n=number of combined heat sources).

In a pattern D (maximum flow rate), the compressor 101 of the heat source device A is in an operating state and the compressor operating time period is shorter than the predetermined time period T0 (minutes) (5 minutes in this case). Thus, in consideration that a compressor activation state is assumed, a rated flow rate (maximum flow rate) of the heat-medium flow regulator 201 is supplied to the heat source device-side heat exchanger 103 as the heat medium (Step S110). At the time of activation of the compressor, a pressure in the refrigerant system is not stabilized. Thus, if the heat-medium flow regulation control is performed, a pressure fluctuation in the refrigerant system is promoted. Consequently, the opening degree of the heat-medium flow regulator 201 changes frequently, resulting in the possibility of causing a pressure fluctuation in a heat medium system. Thus, the rated flow rate is set as a fixed flow rate in consideration of prevention of increase in high pressure at the time of activation of the compressor and freezing of the heat-medium heat exchanger. After the calculation of the necessary flow rate of the heat medium, the necessary flow rate of the heat medium is output to the heat-medium flow regulator 201 as an electric signal. Because assumptions here are that the voltage signal is set within a range of from 0 V to 10 V, 0 V corresponds to the full opening, and 10 V corresponds to the full closure, 0 V is output (Step S111).

As described above, the necessary flow rate of the heat medium is calculated (Steps S105 to S110). The calculated necessary flow rate of the heat medium is converted into the electric signal output value (Step S111). The signal is output to the heat-medium flow regulator 201 (Step S112). After the electric signal is output to the heat-medium flow regulator 201, a timer for the elapsed time period from the previous output is reset (Step S113). The control then returns to the start of the heat medium flow regulation (Step S101) to perform the steps again.

Figure 7:
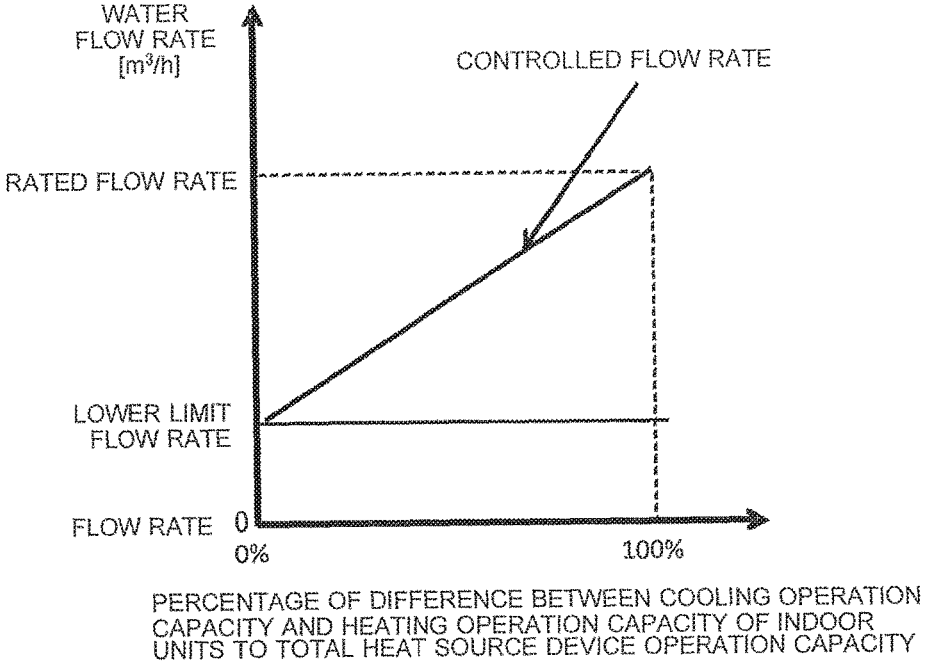
FIG. 7 is a graph for showing an example of a relationship between a use-side heat exchanger capacity and a necessary flow rate of a heat medium to be supplied to a heat source device-side heat exchanger according to Embodiment 2 of the present invention.

The above-mentioned control performed by the heat-medium flow control device 250 can be summarized as shown in FIG. 7. Specifically, the heat medium supplied to the heat source device-side heat exchanger 103 is 0 (zero) in the pattern A, the lower limit flow rate defined by the heat source device A in the pattern B, the flow rate (flow rate of the heat medium Gw shown in FIG. 6) calculated based on the difference between the temperatures of the heat medium at the outlet and the inlet of the heat source device-side heat exchanger 103 in the pattern C, and the maximum flow rate corresponding to the rated flow rate of the heat-medium flow regulator 201 in the pattern D. For the control of the flow rate of the heat medium, the following measures are specifically taken.

The heat-medium flow control device 250 has the lower limit flow rate of the heat medium, which is defined by the heat source device A, as a lower limit value and the flow rate (rated flow rate) corresponding to the maximum opening degree of the heat-medium flow regulator 201 as an upper limit value. The heat-medium flow control device 250 controls the flow rate of the heat medium between the lower limit value and the upper limit value.

A plurality of lower limit values are preferred to be set to be selectable depending on characteristics of the heat-medium flow regulator 201. Further, the lower limit value may be selected from flow rates that do not adversely affect the operation of the heat source device A and are required in consideration of pitting corrosion prevention or freezing prevention of the heat source device-side heat exchanger 103.

The heat-medium flow control device 250 may include the plurality of setting switches 252 or buttons used for setting the lower limit value. The setting switches 252 and the buttons in this case are not used to change the lower limit value itself (minimum flow rate), but are used to make setting so that the minimum flow rate supplied to the heat source device-side heat exchanger 103 becomes the same even when a specification (rated Cv value) of the heat-medium flow regulator 201 is different.

The heat-medium flow control device 250 is preferred to control the heat-medium flow regulator 201 so that the maximum flow rate is ensured after the activation of the compressor 101 included in the heat source device A and transitions to the pattern C with the computed flow rate after elapse of a predetermined time period.

To achieve an earlier transition to the pattern C in a stable state or prevent twisting of a valve of the heat-medium flow regulator 201, the opening degree of the heat-medium flow regulator 201 is preferred to be set to an opening degree that is a little smaller than the maximum opening degree that is the rated opening degree when the maximum flow rate in the pattern D is to be defined.

When the heat source device A is used in combination with an other heat source device, and the compressor 101 of the heat source device A is in a stopped state and a compressor of the other heat source device is operating, the heat-medium flow control device 250 is preferred to set the flow rate of the heat medium supplied to the heat-medium flow regulator 201 to the above-mentioned lower limit value.

When the heat source device A is used in combination with the other heat source device, and the compressor 101 of the heat source device A is in a stopped state and the compressor of the other heat source device is also in a stopped state, the heat-medium flow control device 250 sets the flow rate of the heat medium supplied to the heat-medium flow regulator 201 to zero.

Further, in the pattern C, when a difference between the total cooling capacity and the total heating capacity of the plurality of use-side heat exchangers 105 becomes large, the flow rate of the heat medium supplied to the heat-medium flow regulator 201 is increased.

Further, in the pattern C, the amount of change in the flow rate of the heat medium supplied to the heat-medium flow regulator 201 is increased in proportion to a capacity ratio obtained by dividing the difference between the total cooling capacity and the total heating capacity of the plurality of use-side heat exchangers 105 by the total operation capacity of the heat source device-side heat exchanger (capacity including those of the combined heat sources when the combined heat sources are provided).

In the pattern C, when the above-mentioned capacity ratio is equal to or smaller than a predefined value, the amount of change in supply flow rate of the heat medium is set to zero.

To ensure the flow rate of the heat medium supplied to the heat source device A even when communication between the heat-medium flow control device 250 and the heat-medium flow regulator 201 is disconnected, a combination is preferred to be set so that the flow rate is set small or to the lower limit value when a command electric output value to the heat-medium flow regulator 201 is large and the flow rate is set large or to the rated flow rate when the command electric output value is small.

In the air-conditioning apparatus 1, through the control processing described above, the flow rate of the heat medium supplied to the heat source device A is controlled by using the heat source device operation mode detecting unit 205 and the indoor unit operation mode detecting unit 210 included in the heat source device A, thereby reducing the flow rate of the heat medium depending on the use-side heat exchanger capacity. As a result, power consumption of the heat-medium conveying device 202 (for example, a water pump) can also be reduced while the air-conditioning apparatus 1 maintains comfort. Consequently, with the configuration described above, the effect of enabling the execution of the highly-efficient cooling and heating simultaneous operation can be obtained.

Embodiment 3

Figure 8:
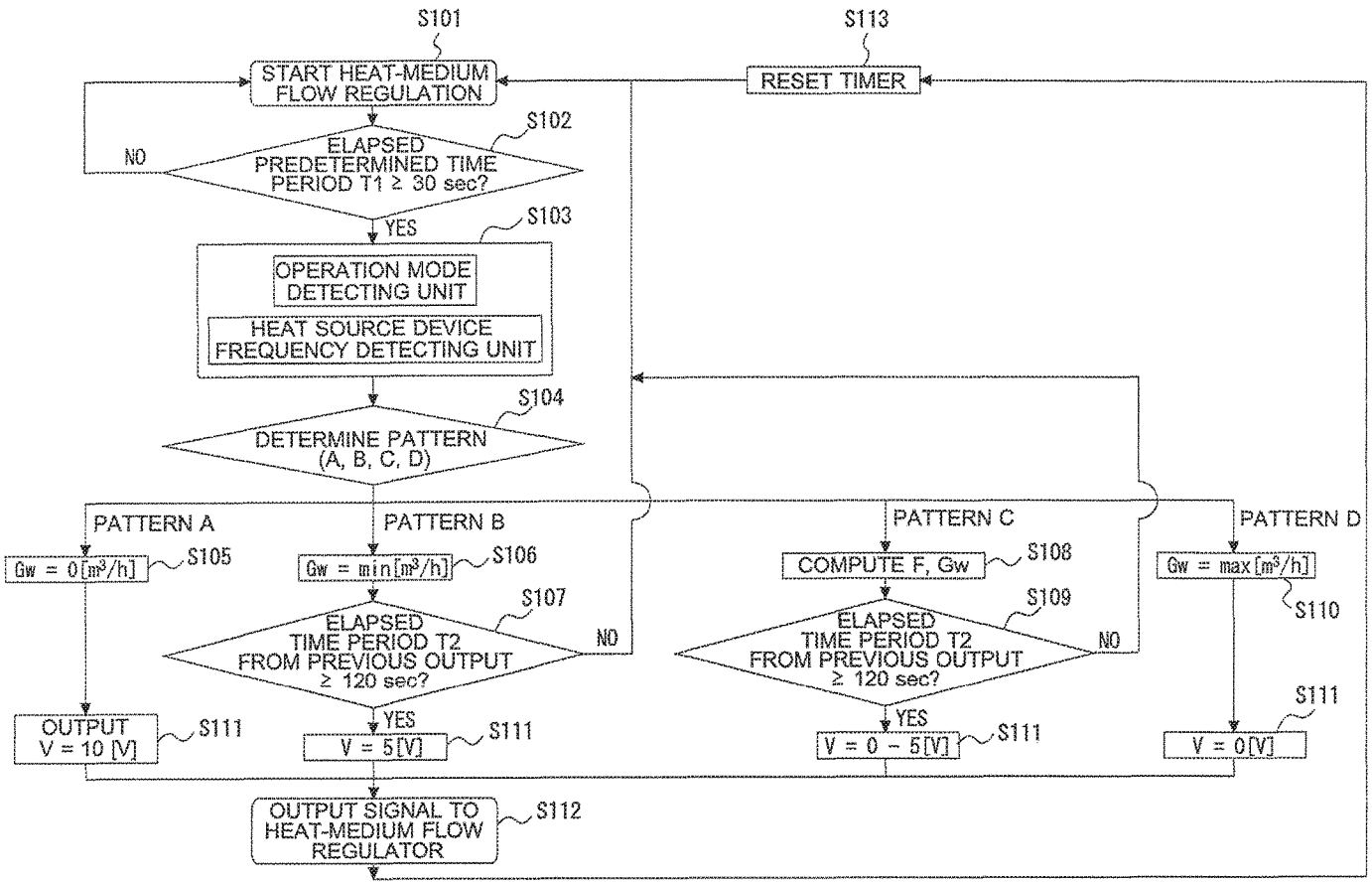
FIG. 8 is a diagram for illustrating an example of a flowchart of heat medium flow regulation control according to Embodiment 3 of the present invention.
Figure 9:
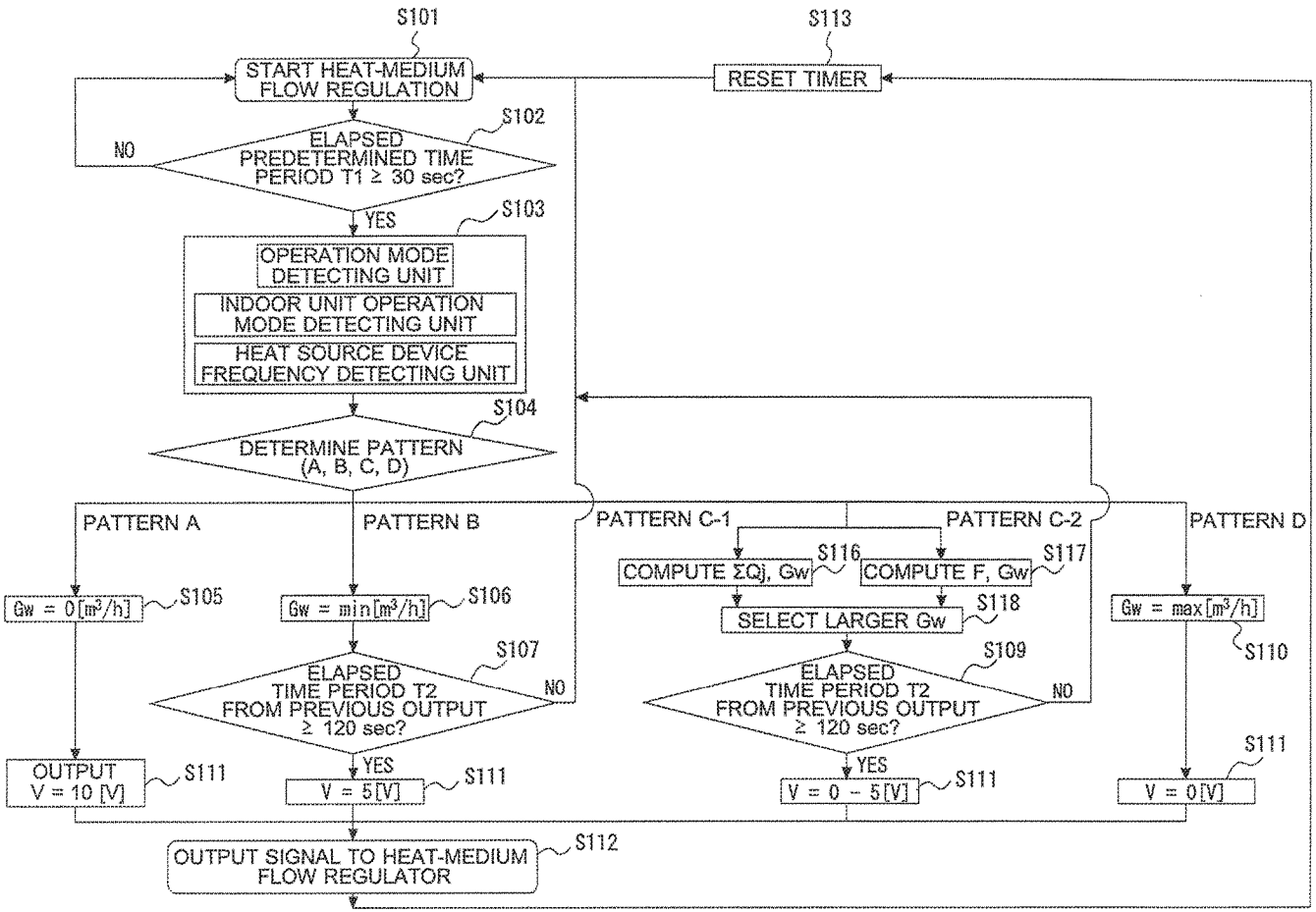
FIG. 9 is a diagram for illustrating another example of a flowchart of the heat medium flow regulation control according to Embodiment 3 of the present invention.

FIG. 8 is a diagram of a flowchart for illustrating a flow of heat-medium flow regulation control performed by the heat-medium flow control device 250 according to Embodiment 3 of the present invention. FIG. 9 is a diagram for illustrating an other example of a flowchart of the heat medium flow regulation control according to Embodiment 3 of the present invention. FIG. 10 is a table for showing an example of four patterns (pattern D has already been described, and thus its description is herein omitted) of the heat-medium flow regulation state according to Embodiment 3 of the present invention. With reference to FIG. 8 to FIG. 10, the pattern C, a pattern C-1, and a pattern C-2 (computed flow rate) are described. In Embodiment 3, description is omitted for the same processing as that of Embodiment 2. The pattern C of FIG. 8 is the same as the pattern C-2 of FIG. 9 and FIG. 10, whereas the pattern C-1 of FIG. 9 and FIG. 10 is the same as the pattern C of FIG. 5 and FIG. 6.

FIG. 8 is different from FIG. 5 and FIG. 6 in terms of the pattern C. In the pattern C in this case, the "flow rate of the heat medium Gw" is calculated by the heat-medium flow control device 250 from an expression shown in the pattern C-2 of FIG. 10 based on the heat medium rated flow rate, the operating frequency of the compressor of the heat source device A, a maximum frequency of the compressor of the heat source device A, and a minimum frequency of the compressor of the heat source device A.

In FIG. 9, the "flow rate of the heat medium Gw" is calculated and defined based on a first computed flow rate calculated based on the heat medium rated flow rate, the sum of the indoor unit cooling operation capacities, the sum of the indoor unit heating operation capacities, and the operation capacity of the heat source device A in the pattern C-1 and a second computed flow rate calculated based on the operating frequency of the compressor of the heat source device A, the maximum frequency of the compressor of the heat source device A, and the minimum frequency of the compressor of the heat source device A in the pattern C-2 (Step S116, Step S117).

In Step S116, the first computed flow rate is calculated based on the sum of the indoor unit cooling operation capacities, the sum of the indoor unit heating operation capacities, and the operation capacity of the heat source device A. In Step S117, the second computed flow rate is calculated based on the operating frequency of the compressor of the heat source device A, the maximum frequency of the compressor of the heat source device A, and the minimum frequency of the compressor of the heat source device A. When the operating frequency of the compressor of the heat source device A is larger than the minimum frequency of the compressor of the heat source device, the heat-medium flow control device 250 increases the flow rate of the heat medium supplied to the heat-medium flow regulator 201. In Step S118, the heat-medium flow control device 250 sets a larger one of the first computed flow rate and the second computed flow rate as the flow rate of the heat medium supplied to the heat-medium flow regulator 201.

Further, to minimize a variation in flow rate on a water quantity side, the heat medium rated flow rate may be divided into steps to have a certain range, and a representative flow rate may be output for a numerical value within the range of a step. For example, when the minimum flow rate is set to 2 $m^3/h$ and the rated flow rate is set to 6 $m^3/h$, Step 1, Step 2, Step 3, and Step 4 are preferred to correspond to 2 $m^3/h$, 3 $m^3/h$ (2 $m^3/h$ to 3 $m^3/h$), 4 $m^3/h$ (3 $m^3/h$ to 4 $m^3/h$), and 5 $m^3/h$ (4 $m^3/h$ to 5 $m^3/h$), respectively.

REFERENCE SIGNS LIST

A heat source device B relay device C, D indoor unit 1 air-conditioning apparatus 101 compressor 102 four-way valve 103 heat source device-side heat exchanger 104 accumulator 105, 105*c*, 105*d* use-side heat exchanger 106 first connecting pipe 106*c* third connecting pipe 106*d* fifth connecting pipe 107 second connecting pipe 107*c* fourth connecting pipe 107*d* sixth connecting pipe 108, 108*a*, 108*b* electromagnetic valve 109, 109*c*, 109*d* first flow regulator 110 first branch unit 111 second branch unit 112 gas-liquid separator 113 second flow regulator 114 bypass pipe 115 third flow regulator 116 first heat exchanger 117 second heat exchanger 118 to 121, 137*a*, 137*b* check valve 122 fourth flow regulator 123 gas-liquid separator 124 fifth flow regulator 125 switching valve 126 first pressure detecting unit 127 second pressure detecting unit 128 inlet temperature detecting unit 129 outlet temperature detecting unit 130*a* third pressure detecting unit 130*b* fourth pressure detecting unit 131*a*, 131*b* check valve 131*a*_all, 131*b*_all joining portion 132 temperature detecting unit 133 liquid-pipe temperature detecting unit 134 gas-pipe temperature detecting unit 141, 151 control unit 201 heat-medium flow regulator 202 heat-medium conveying device 203 heat-medium inflow temperature detecting unit 204 heat-medium outflow temperature detecting unit 205 heat source device operation mode detecting unit 210 indoor unit operation mode detecting unit 250 heat-medium flow control device 251 heat-medium temperature difference computing unit 252 setting switch

The invention claimed is:

1. An air-conditioning apparatus, comprising:

a compressor configured to compress and discharge refrigerant;

a heat source device-side heat exchanger configured to exchange heat between the refrigerant and a heat medium different from the refrigerant;

a plurality of use-side heat exchangers configured to exchange heat between the refrigerant and a use-side medium around the plurality of use-side heat exchangers;

a relay device provided between the heat source device-side heat exchanger and the plurality of use-side heat exchangers, the relay device includes a gas-liquid separator, a flow regulator, an intermediate heat exchanger, and a relay controller configured to switch at least one of the plurality of use-side heat exchangers to a cooling operation and switch others of the plurality of use-side heat exchangers to a heating operation; and at least one system including a heat-medium pump, a heat-medium flow regulator, and a heat-medium flow controller, as a heat medium system capable of regulating a flow rate of the heat medium supplied to the heat source device-side heat exchanger, the compressor and the heat source device-side heat exchanger being arranged in a heat source device and the plurality of use-side heat exchangers being arranged in an indoor unit, the air-conditioning apparatus being configured to switch each of the plurality of use-side heat exchangers to the cooling operation or the heating operation in accordance with a control command to perform a cooling and heating simultaneous operation, the refrigerant being caused to flow through the heat source device-side heat exchanger depending on a ratio of a total cooling capacity and a total heating capacity of the plurality of use-side heat exchangers, the heat-medium flow controller being configured to control the flow rate of the heat medium supplied to the heat source device-side heat exchanger based on the total cooling capacity and the total heating capacity of the plurality of use-side heat exchangers and a total operation capacity of the heat source device-side heat exchanger, the heat-medium flow controller being configured to control the flow rate of the heat medium between a lower limit value of the heat medium defined by the heat source device and an upper limit value of a flow rate corresponding to a maximum opening degree of the heat-medium flow regulator, and the heat-medium flow controller being configured to include a plurality of the lower limit values being set to be selectable depending on a characteristic of the heat-medium flow regulator.

2. The air-conditioning apparatus of claim 1, wherein the lower limit value is selected from a flow rate for pitting corrosion prevention or a flow rate for freezing prevention of the heat source device-side heat exchanger, the selected flow rate causing no adverse effect on an operation of the heat source device.

3. The air-conditioning apparatus of claim 1, further comprising a plurality of switches or buttons used for setting the lower limit value.

4. The air-conditioning apparatus of claim 1, wherein the heat-medium flow controller is configured to control, depending on an operation mode of the heat source device, the heat-medium flow regulator in four patterns including a zero flow rate for causing no heat medium to flow, a lower limit flow rate corresponding to a minimum flow rate defined by the heat source device, a computed flow rate calculated and defined based on a total capacity of the at least one of the plurality of use-side heat exchangers performing the cooling operation, a total capacity of the others of the plurality of use-side heat exchangers performing the heating operation, and the total operation capacity of the heat source device-side heat exchanger, and a maximum flow rate corresponding to a rated flow rate of the heat-medium flow regulator.

5. The air-conditioning apparatus of claim 4, wherein the heat-medium flow controller is configured to control the heat-medium flow regulator so that the maximum flow rate is set after activation of the compressor included in the heat source device and transitions to the pattern with the computed flow rate after elapse of a predetermined time period.

6. The air-conditioning apparatus of claim 4, wherein, when the heat source device is used in combination with an other heat source device, and the compressor of the heat source device is in a stopped state and a compressor of the other heat source device is operating, the heat-medium flow controller sets the flow rate of the heat medium supplied to the heat-medium flow regulator to the lower limit flow rate.

7. The air-conditioning apparatus of claim 4, wherein, when the heat source device is used in combination with an other heat source device, and the compressor of the heat source device is in a stopped state and a compressor of the other heat source device is in a stopped state, the heat-medium flow controller sets the flow rate of the heat medium supplied to the heat-medium flow regulator to zero.

8. The air-conditioning apparatus of claim 4, wherein, in the pattern with the computed flow rate, when a difference between the total cooling capacity and the total heating capacity of the plurality of use-side heat exchangers increases, the flow rate of the heat medium supplied to the heat-medium flow regulator is increased.

9. The air-conditioning apparatus of claim 4, wherein, in the pattern with the computed flow rate, an amount of change in the flow rate of the heat medium supplied to the heat-medium flow regulator is increased in proportion to a capacity ratio obtained by dividing a difference between the total cooling capacity and the total heating capacity of the plurality of use-side heat exchangers by the total operation capacity of the heat source device-side heat exchanger.

10. The air-conditioning apparatus of claim 4, wherein, in the pattern with the computed flow rate, when a capacity ratio obtained by dividing a difference between the total cooling capacity and the total heating capacity of the plurality of use-side heat exchangers by the total operation capacity of the heat source device-side heat exchanger is equal to or smaller than a predefined value, an amount of change in supply flow rate of the heat medium is set to zero.

11. The air-conditioning apparatus of claim 4, wherein an electric output value of an opening degree command output to the heat-medium flow regulator is set so that an electric output value corresponding to the maximum flow rate becomes smaller than an electric output value corresponding to the lower limit flow rate.

12. The air-conditioning apparatus of claim 1, wherein the heat-medium flow controller is configured to control the flow rate of the heat medium supplied to the heat source device-side heat exchanger by using a sum of indoor unit cooling operation capacities, a sum of indoor unit heating operation capacities, an operation capacity of the heat source device, an operating frequency of the compressor of the heat source device, a maximum frequency of the compressor of the heat source device, and a minimum frequency of the compressor of the heat source device.

13. The air-conditioning apparatus of claim 12, wherein the heat-medium flow controller is configured to control, depending on an operation mode of the heat source device, the heat-medium flow regulator in four patterns including a zero flow rate for causing no heat medium to flow, a lower limit flow rate corresponding to a minimum flow rate determined by the heat source device, a computed flow rate calculated and defined based on a first computed flow rate calculated based on the sum of the indoor unit cooling operation capacities, the sum of the indoor unit heating operation capacities, and the operation capacity of the heat source device and a second computed flow rate calculated based on the operating frequency of the compressor of the heat source device, the maximum frequency of the compressor of the heat source device, and the minimum frequency of the compressor of the heat source device, and a maximum flow rate corresponding to a rated flow rate of the heat-medium flow regulator.

14. The air-conditioning apparatus of claim 13, wherein, in the pattern with the computed flow rate, the heat-medium flow controller sets a larger one of the first computed flow rate and the second computed flow rate as the flow rate of the heat medium supplied to the heat-medium flow regulator.

15. An air-conditioning apparatus, comprising:

a compressor configured to compress and discharge refrigerant;

a heat source device-side heat exchanger configured to exchange heat between the refrigerant and a heat medium different from the refrigerant;

a plurality of use-side heat exchangers configured to exchange heat between the refrigerant and a use-side medium around the plurality of use-side heat exchangers;

a relay device provided between the heat source device-side heat exchanger and the plurality of use-side heat exchangers, the relay device includes a gas-liquid separator, a flow regulator, an intermediate heat exchanger, and a relay controller configured to switch at least one of the plurality of use-side heat exchangers to a cooling operation and switch others of the plurality of use-side heat exchangers to a heating operation; and at least one system including a heat-medium pump, a heat-medium flow regulator, and a heat-medium flow controller, as a heat medium system capable of regulating a flow rate of the heat medium supplied to the heat source device-side heat exchanger, the compressor and the heat source device-side heat exchanger being arranged in a heat source device and the plurality of use-side heat exchangers being arranged in an indoor unit, the air-conditioning apparatus being configured to switch each of the plurality of use-side heat exchangers to the cooling operation or the heating operation in accordance with a control command to perform a cooling and heating simultaneous operation, the heat-medium flow controller being configured to control the flow rate of the heat medium supplied to the heat source device-side heat exchanger by using an operating frequency of the compressor of the heat source device, a maximum frequency of the compressor of the heat source device, and a minimum frequency of the compressor of the heat source device, the heat-medium flow controller being configured to, depending on an operation mode of the heat source device, control the heat-medium flow regulator in four patterns including a zero flow rate for causing no heat medium to flow, a lower limit flow rate corresponding to a minimum flow rate defined by the heat source device, a computed flow rate calculated and defined based on the operating frequency of the compressor of the heat source device, the maximum frequency of the compressor of the heat source device, and the minimum frequency of the compressor of the heat source device, and a maximum flow rate corresponding to a rated flow rate of the heat-medium flow regulator.

16. The air-conditioning apparatus of claim 15, wherein, in the pattern with the computed flow rate, when the operating frequency of the compressor of the heat source device is larger than the minimum frequency of the compressor of the heat source device, the heat-medium flow controller increases the flow rate of the heat medium supplied to the heat-medium flow regulator.

17. An air-conditioning apparatus, comprising:

a compressor configured to compress and discharge refrigerant;

a heat source device-side heat exchanger configured to exchange heat between the refrigerant and a heat medium different from the refrigerant;

a plurality of use-side heat exchangers configured to exchange heat between the refrigerant and a use-side medium around the plurality of use-side heat exchangers;

a relay device provided between the heat source device-side heat exchanger and the plurality of use-side heat exchangers, the relay device includes a gas-liquid separator, a flow regulator, an intermediate heat exchanger, and a relay controller configured to switch at least one of the plurality of use-side heat exchangers to a cooling operation and switch others of the plurality of use-side heat exchangers to a heating operation; and at least one system including a heat-medium pump, a heat-medium flow regulator, and a heat-medium flow controller, as a heat medium system capable of regulating a flow rate of the heat medium supplied to the heat source device-side heat exchanger, the compressor and the heat source device-side heat exchanger being arranged in a heat source device and the plurality of use-side heat exchangers being arranged in an indoor unit, the air-conditioning apparatus being configured to switch each of the plurality of use-side heat exchangers to the cooling operation or the heating operation in accordance with a control command to perform a cooling and heating simultaneous operation, the heat-medium flow controller being configured to control the flow rate of the heat medium supplied to the heat source device-side heat exchanger by using an operating frequency of the compressor of the heat source device, a maximum frequency of the compressor of the heat source device, and a minimum frequency of the compressor of the heat source device, the heat-medium flow controller being configured to control the flow rate of the heat medium between a lower limit value of the heat medium defined by the heat source device and an upper limit value of a flow rate corresponding to a maximum opening degree of the heat-medium flow regulator, the heat-medium flow controller being configured to include a plurality of the lower limit values being set to be selectable depending on a characteristic of the heat-medium flow regulator.

* * * * *